US006752601B2

(12) United States Patent
Takeuchi et al.

(10) Patent No.: US 6,752,601 B2
(45) Date of Patent: Jun. 22, 2004

(54) MICROPUMP

(75) Inventors: Yukihisa Takeuchi, Nagoya (JP); Hiroyuki Tsuji, Nagoya (JP); Kazumasa Kitamura, Nagoya (JP); Nobuo Takahashi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/935,087

(22) Filed: Aug. 22, 2001

(65) Prior Publication Data

US 2002/0146330 A1 Oct. 10, 2002

Related U.S. Application Data

(63) Continuation-in-part of application No. 09/900,742, filed on Jul. 6, 2001.

(30) Foreign Application Priority Data

Apr. 6, 2001 (JP) ..... 2001-108986
Jun. 22, 2001 (JP) ..... 2001-189718

(51) Int. Cl.[7] ..... F04B 35/00
(52) U.S. Cl. ..... 417/322; 417/413.2
(58) Field of Search ..... 417/322, 413.2

(56) References Cited

U.S. PATENT DOCUMENTS 4,752,788 A * 6/1988 Yasuhara et al. ..... 417/322
5,215,446 A * 6/1993 Takahashi et al. ..... 417/322
5,307,311 A * 4/1994 Sliwa, Jr. ..... 365/174
5,542,821 A * 8/1996 Dugan ..... 417/322
5,906,481 A * 5/1999 Ogawa et al. ..... 417/413.2
6,116,863 A * 9/2000 Ahn et al. ..... 417/322
6,203,291 B1 * 3/2001 Stemme et al. ..... 417/413.2
6,431,212 B1 * 8/2002 Hayenga et al. ..... 417/413.2

OTHER PUBLICATIONS

U.S. patent application Ser. No. 09/268,759, Takeuchi et al., filed Mar. 16, 1999.

* cited by examiner

*Primary Examiner*—Cheryl J. Tyler
(74) *Attorney, Agent, or Firm*—Burr & Brown

(57) ABSTRACT

A micro pump having at least one pump member for conveying a fluid by action of pressure includes a pump unit formed by at least one actuator member for generating a pressure fluctuation and a fluid channel in which the fluid flows. The actuator member provided with a cell formed by disposing two side walls made of piezoelectric/electrostrictive elements or antiferrodielectric elements on a connecting plate, and covering a surface facing the connecting plate between the side walls with a cover plate. The actuator member selectively forms the fluid channel and generates pressure fluctuation in the fluid channel member due to displacement of the cell caused by expansion/contraction of the side walls. The micro pump is small and thin in size, while attaining increasing fluid ejection amounts, and a thigh speed in response.

13 Claims, 12 Drawing Sheets

FIG.1(a)
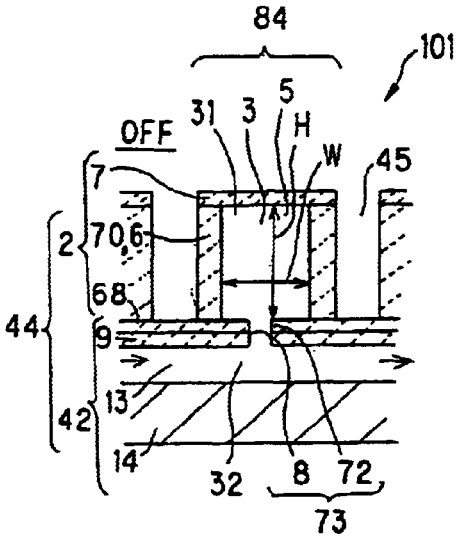
FIG.1(b)
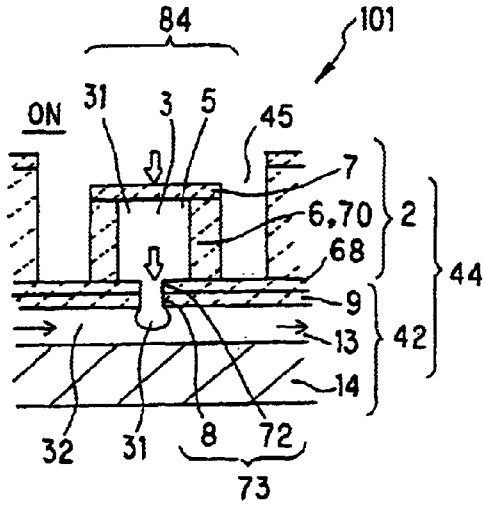
FIG.2 -Prior Art
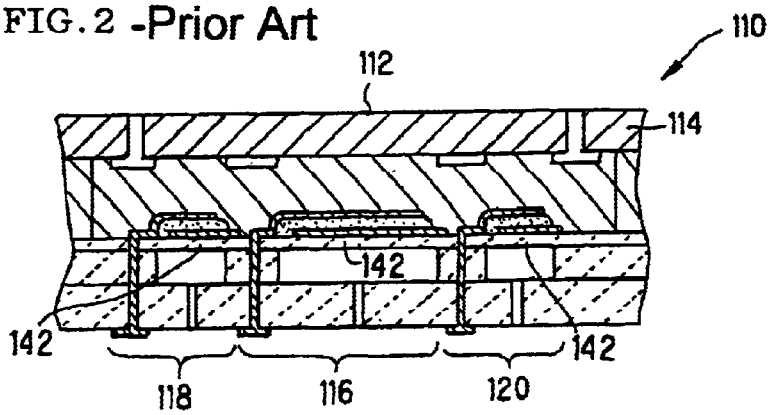

15
25
16
16
16
16
16
PUNCH·LAMINATION·HEAT PRESS
UNIFY BY FIRING
P 5
45
70
JOINING 2
7
70
68
72

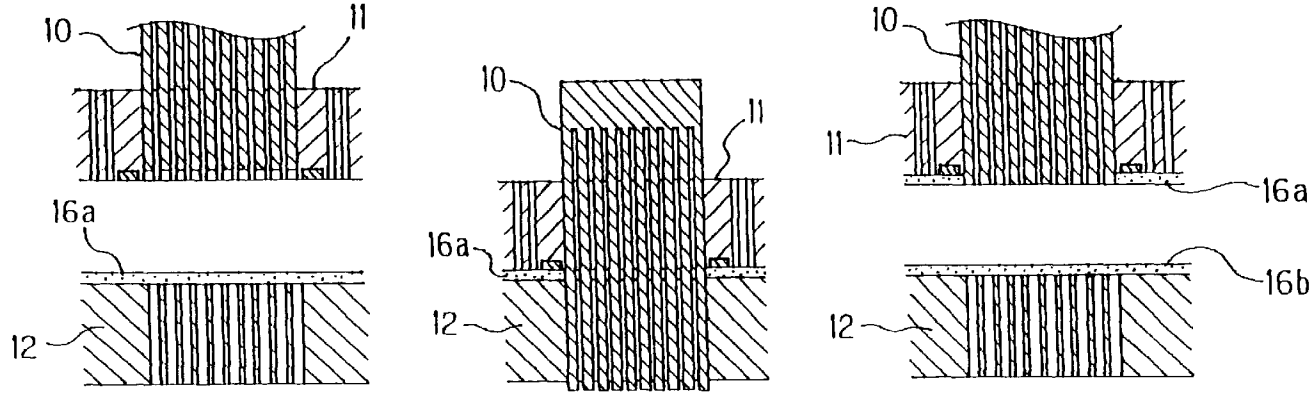
FIG.6(a)
FIG.6(b)
FIG.6(c)
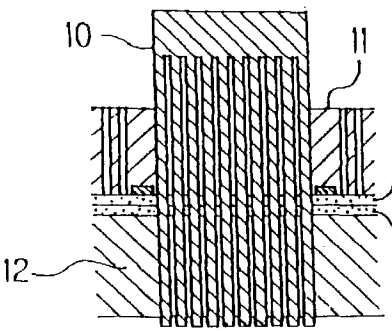
FIG.6(d)
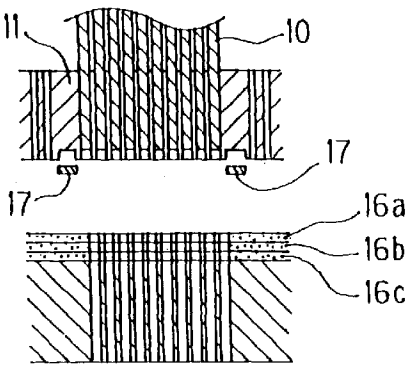
FIG.6(e)

MICROPUMP

CROSS-REFERENCE TO RELATED APPLICATIONS

This application is a continuation in part of U.S. patent application Ser. No. 09/900,742 filed on Jul. 6, 2001.

BACKGROUND OF THE INVENTION AND RELATED ART

The present invention relates to a micro pump preferably having a small and thin structure.

In recent years, a micro pump driven by electrostatic force has been proposed in the field of micro machines which are produced by finely structuring a silicon substrate. Such a micro pump can be used either in a device embedded in a human body for injecting a very small amount of medicine thereinto or a small instrument for chemical analyses. It is known that such a micro pump is normally made of silicon, and it will be assumed that the micro pump is increasingly used in the field of medical treatment, chemical analyses and so on. In this case, it is preferable that the micro pump should have a small and thin structure, and in spite of these requirements, the micro pump ensures a greater amount of discharge (or a greater amount of displacement) for the fluid used.

In such a micro pump, however, it is very difficult to attain either a higher speed in pumping action or a greater amount of discharge (a greater magnitude of displacement) for a fluid.

In order to overcome such problems, the following pump has been proposed in Japanese Unexamined Patent Application Publication No. 2000-314381. FIG. 2 is a sectional view of the pump, which has a small and thin structure and at the same time provides a greater amount of discharge (a greater amount of displacement) for the fluid. The pump 110 comprises a casing 114, into which a fluid is supplied, a supply valve member 118 disposed so as to face the inside of the casing 114, a pump member 116, a discharge valve member 120, and a pump main body 112. A fluid channel is selectively formed in the inside of the casing 114 by the selective displacement of the supply valve member 118 the pump member 116, and the discharge valve member 120 in the approaching/departing direction, such that the flow of the fluid can be controlled by selectively forming the fluid channel.

In such a pump 110, however, the following problems exists. Since the displacement action of the pump member 116 resulted from the bending movement of a vibrating member 142, both the compression force and the magnitude of stroke in the discharge direction of the fluid were restricted, so that there was a limitation in manufacturing a pump having a small and thin structure in order to obtain a higher performance. The upper limit of the bending deformation of the vibrating member is determined by the toughness of the vibrating member 142, so that it is effective to decrease the thickness of the vibrating member 142, if the magnitudes of the bending deformation and the stroke can be increased in order to obtain a greater compression force. However, if so designed, the rigidity of the vibrating member 142 decreases and thus a high responsiveness is reduced. On the contrary, if the area of the vibrating member 142 can be increased, this causes an increase in the size of the vibrating member, hence making it impossible to provide a pump having a small and thin structure. On the other hand, an excellent responsiveness requires an increase of the rigidity. For this purpose, it is effective to increase the thickness of the vibrating member 142 in the pump 110. However, if so designed, the obtainable displacement is decreased and therefore the required compression force cannot be obtained. In other words, it was difficult to simultaneously attain both a greater compression force and a high responsiveness by the bending deformation of the vibrating member 142 in the pump 110.

Taking the above-mentioned problems into account, the object of the present invention is to provide a micro pump, which has a small and thin structure, and at the same time, ensures an increased amount of discharge (increased magnitude of displacement) and a high responsiveness. After many investigations were done regarding the structure for micro pumps, components for producing the displacement action and methods for producing the displacement action, it has been found that the above-mentioned object can be attained by the micro pump of the present invention, which is described below.

There is provided, in accordance with the invention, a micro pump having at least one pump member for conveying a fluid by the action of pressure, characterized in that, pump member comprises a pump unit which is formed from at least one actuator member for generating a pressure fluctuation and a fluid channel member in which a fluid flows. The actuator member is provided with a cell formed by disposing two side walls made of piezoelectric/electrostrictive elements or antiferrodielectric elements on a connecting plate, and a cover plate is positioned on the side walls and faces the connecting plate. The actuator member selectively forms a fluid channel and generates pressure fluctuation in the fluid channel member due to the displacement of the cell caused by expansion/contraction of the side walls.

In the pump unit, electrode layers are formed on both surfaces of the side walls in the actuator member, and the side walls are preferably expanded/contracted in the up/down direction in accordance with the driving electric field by applying a voltage to the electrode layers. For this purpose, the electric field for polarizing the piezoelectric/electrostrictive elements forming the side walls of the actuator member is aligned in the same direction as the driving electric field. Moreover, it is preferable that the state of crystalline grains on the surfaces of the side walls in the actuator member is that the crystalline grains suffering the fracture inside the grains are less than 1% and that the degree of profile of the surfaces of the cell in the actuator member is approximately 8 $\mu$m or less.

In the pump unit, moreover, it is preferable that the ratio of the inside width to the height of the cell in the actuator member is approximately 1:2 to 1:40, and that the inside width of the cell in the actuator member is approximately less than 60 $\mu$m. It is further preferable that the surface roughness Rt of the side walls in the actuator member is approximately 10 $\mu$m or less.

In the actuator member of the pump unit, it is preferable that the connecting plate is made of piezoelectric/electrostrictive elements or antiferroelectric elements and joined to the side walls to form one body, and it is also preferable that the cover plate is made of piezoelectric/electrostrictive elements or antiferrodielectric elements and joined to the side walls to form one body.

In the present invention, for example, one of pump unit (A), pump unit (B) and pump unit (C) (which are each described below in detail) can be employed in the various embodiments. The pump unit (A) is constituted in such a manner that the cell in the actuator member is filled with a system fluid and another fluid, which is unsoluable in the system fluid flows in a fluid channel that is formed in advance in the fluid channel member. The cell is in communication with the fluid channel via a communicating hole, and the fluid channel has substantially the same size in the width direction as the diameter of the communicating hole, at least at the position where the communicating hole is in communication with to the fluid channel. The expansion/contraction (in the up/down direction) of the side walls forming the cell provides a change in the volume of the portion at which the system fluid stored in the cell is ejected from the communicating hole into the fluid channel, such that the fluid channel can be selectively formed.

The pump unit (B) is constituted in such a manner that the fluid channel is formed by a displacement transmitting member, at least a part of which is bonded to the cover plate of the cell in the actuator member, and a casing facing a part of the surface of the displacement transmitting member on the side opposite to the actuator member. The expansion/contraction of the side walls forming the cell provides an approaching/departing displacement of the displacement transmitting member relative to a part of the surfaces of the casing facing the displacement transmitting member, such that the fluid channel can be selectively formed.

In the pump unit (B), it is preferable that a communicating hole, through which the inside of the cell is communicated to the outside thereof, is formed. It is preferable that the fluid channel is closed when the displacement transmitting member comes into contact with the casing. Furthermore, it is preferable that a plurality of the actuator members are employed in accordance with the displacement transmitting members that form the fluid channel.

In the pump unit (B), when a plurality of the actuator members is employed in accordance with the displacement transmitting members that form the fluid channel, it is preferable that the ratio of the spacing between a cell and the adjacent cell to the height of the cell is approximately 1:2 to 1:40, and that the spacing between the cell and the adjacent cell is approximately 50 mm or less. Moreover, it is preferable that the inside width of the cell or the spacing between the cell and the adjacent cell has two different distances.

Regarding the actuator member in the above-mentioned pump unit (B), it is preferable that the outside of the cell is filled with the same material as the displacement transmitting member, and the actuator and the fluid channel member is unified into one body.

The pump unit (C) is constituted in such a manner that a fluid supply opening and a fluid discharge opening are formed in the cell of the actuator member, and a fluid channel including a supply channel portion and a discharge channel portion, in which a fluid flows, is formed in advance in the fluid channel member. The supply channel portion is in communication the fluid supply opening in the cell and the discharge channel is in communication with to the fluid discharge opening in the cell. The expansion/contraction of the side walls forming the cell provides a change in the volume of the cell and thus produces a pressure in the cell, such that the fluid channel can be selectively formed. In accordance with the invention, a micro pump including at least one pump member is provided, wherein the pump unit (A), the pump unit (B) and the pump unit (C), which are described above, are used as a pump member.

Moreover, in the micro pump according to the invention, wherein the micro pump includes the pump unit (A), the pump unit (B) and the pump unit (C) which are described above, it is desirable that pressure loss generating elements are each disposed on the supply side and the discharge side of the fluid channel. Assuming a pressure loss $\Delta P1$ when the fluid flows in the supply direction and a pressure loss $\Delta P2$ when the fluid flows in the direction opposite the supply direction at the pressure loss generating element on the supply side, and assuming a pressure loss $\Delta P3$ when the fluid flows in the discharge direction and a pressure loss $\Delta P4$ when the fluid flows in the direction opposite the discharge direction at the pressure loss generating element on the discharge side, the following two equations, $\Delta P1<\Delta P4$ and $\Delta P2>\Delta P3$ are satisfied. In order to satisfy these conditions, the pressure loss generating element on the supply side has a tapered structure whose cross section continuously decreases in the supply direction of the fluid, and the pressure loss generating element on the discharge side has a tapered structure which continuously decreases in the discharge direction of the fluid. Moreover, each pressure loss generating element on the supply side and on the discharge side can be used check valve.

In the present invention, it is preferable that the pump members constituted by such pump units are used, and there is at least one set of serial connections in the pump members. It is also preferable that the pump members are used wherein there is an arbitrary combination of serial connection and/or parallel connection in the pump members. In this case, it is desirable that at least one set of two pump members connected in series among the pump members provides a phase difference in the pressure fluctuation arisen in the fluid channel member, thereby enabling the flow of the fluid to be controlled in the fluid channel member. Furthermore, when a plurality of pump members is used, it is preferable that the pump units in the pump members are of the same type.

It is also preferable that when a plurality of pump members are used, a valve member including one of the pump unit (A), the pump unit (B) and the pump unit (C) is interposed between at least one adjacent pump member. In this case, it is preferable that the pump unit in the pump member and the pump unit in the valve member are, for example, the pump unit (B), and therefore they are the same type pump unit.

In the present invention, it is preferable that at least one supply valve member comprising one of the pump unit (A), the pump unit (B) and the pump unit (C), which are described above, is disposed on the supply side of the pump member. In this case, it is preferable that the pump unit in the pump member and the pump unit in the supply valve member are the pump unit (C), and therefore they are the same type pump unit.

In addition, it is preferable that at least one discharge valve member comprising one of the pump unit (A), the pump unit (B) and the pump unit (C), which are described above, is disposed on the discharge side of the pump member. In this case, it is preferable that the pump unit in the pump member and the pump unit in the discharge valve member are the pump unit (A), and therefore they are the same type pump unit.

In the present invention, the actuator member in the pump unit, which is used as a pump member or a valve member, comprises a spacer plate made of piezoelectric/electrostrictive elements or antiferrodielectric elements in which a plurality of slits (A) is formed, a cover plate placed on one surface of said spacer plate for covering the slits (A) and a connecting plate placed on the other surface of the spacer plate for covering the slits (A), wherein a slit (B) passing through the cover plate and the spacer plate is formed between adjacent slits (A).

In accordance with the present invention, the following method for manufacturing a micro pump is provided. That is, the method for manufacturing a pump with a punch and a die, wherein cells are formed by two side walls made of piezoelectric/electrostrictive elements or antiferrodielectric elements disposed on a connecting plate and by a cover plate for covering the surface facing the connecting plate between the side walls, wherein the micro pump includes actuator members providing a displacement by the expansion/contraction of the side walls, wherein the method comprises the steps of: preparing a plurality of green sheets made of piezoelectric/electrostrictive material or antiferrodielectric material; performing a first substep for diecutting first slit apertures in a first green sheet with the punch, a second substep for raising the first green sheet in tight contact with a stripper, while maintaining the state in which the punch is not withdrawn from the first slit apertures and a third substep for raising the punch in such a manner that the front end of the punch is withdrawn slightly from the lowest part of the first green sheet raised; performing a fourth substep for diecutting second slit apertures in a second green sheet with the punch, a fifth substep for raising the second green sheet together with the first green sheet, while maintaining the state in which the punch is not withdrawn from the second slit apertures and a sixth substep for raising the punch in such a manner that the front end of the punch is withdrawn slightly from the lowest part of the second green sheet raised; subsequently laminating green sheets by repeating the fourth substep to the sixth substep to form a piezoelectric/electrostrictive element or antiferrodielectric element having a plurality of slits.

BRIEF DESCRIPTION OF THE DRAWINGS

FIGS. 1(*a*) and (*b*) are sectional views of an embodiment of a micro pump according to the invention: FIG. 1(*a*) shows the deactivated state; and FIG. 1(*b*) shows the activated state.

FIG. 2 is a sectional view of an embodiment of a conventional pump.

FIGS. 6(*a*) to (*e*) are drawings showing an embodiment of the method of the simultaneous punching and laminating procedure for punching slit apertures and for laminating green sheets shown in FIG. 3(*a*): FIG. 6(*a*) shows a preparing step for placing a first green sheet on a die; FIG. 6(*b*) shows a step for punching the first green sheet; FIG. 6(*c*) shows a preparing step for placing a second green sheet; FIG. 6(*d*) shows a step for punching the second green sheet; and FIG. 6(*e*) shows a punching completing step for removing the laminated green sheets from a stripper after punching and laminating all the green sheets.

FIG. 7(*a*) shows the deactivated state and FIG. 7(*b*) shows the activated state.

FIG. 8(*a*) shows the deactivated state and FIG. 8(*b*) shows the activated state.

FIG. 13(*a*) is a vertical sectional view; and FIG. 13(*b*) is a horizontal sectional view.

FIG. 14(*a*) is a vertical sectional view; and FIG. 14(*b*) is a horizontal sectional view.

FIG. 15(*a*) is a vertical sectional view; and FIG. 15(*b*) is a horizontal sectional view.

DETAILED DESCRIPTION OF THE INVENTION

Figures 3A, 3B, 3C:
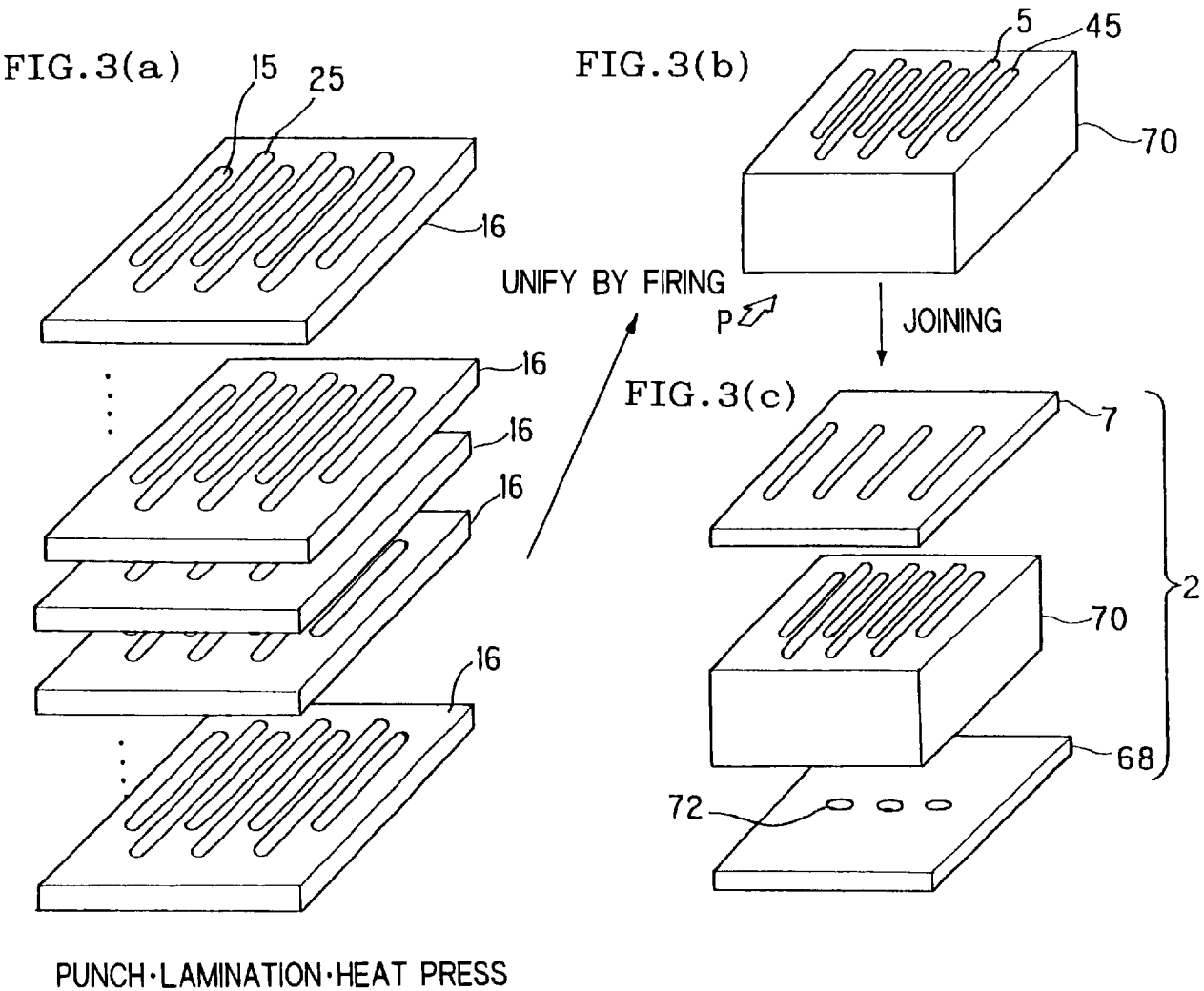
FIGS. 3(*a*) to (*c*) are schematic drawings for explaining the method for manufacturing a micro pump according to the invention in an embodiment.

In the following, referring to the drawings, a significant feature of micro pumps according to the invention will be elucidated. However, the present invention is not restricted by this description, rather, various modifications, revisions and alterations are possible, based on the knowledge of a person skilled in the art, without departing from the spirit or scope of the present invention. The micro pump according to the invention is a pump having a small and thin structure, and allows conveying a fluid with the aid of pressure. The micro pump comprises at least one pump member, which is constituted by a pump unit. The pump unit comprises at least one actuator member for producing a pressure fluctuation and a fluid channel member in which a fluid flows. The actuator member forms a cell by arranging two side walls made of piezoelectric/electrostrictive elements or antiferrodielectric elements on a connecting plate and by covering the surface facing the connecting plate between the side walls with a cover plate.

In the present invention, various structural features are possible regarding the pump units, as will be later described. For all features, however, the novelty commonly resides in that the pressure change in a fluid channel member results from the expanding/contracting displacement of the side walls in the cells of the actuator member, so that the fluid channel can be selectively formed. Since the side walls as a driving member produces a pressure due to the expansive/constrictive deformation, there is no need that the driving member is designed to have a reduced thickness. As a result, there is neither a problem that the rigidity decreases nor a problem that the responsiveness is reduced. Hence, a greater displacement and a higher responsiveness can simultaneously be obtained.

FIGS. 1(*a*) and (*b*) are sectional views of an embodiment of a micro pump according to the invention. FIG. 1(*a*) shows the deactivated (OFF) state, and FIG. 1(*b*) shows the activated (ON) state. Each micro pump 101 comprises a pump member 84, and it is constituted by a pump unit (A) 44. The pump unit (A) 44 comprises an actuator member 2 and a fluid channel member 42. A cell 3 in the actuator member 2 is formed by side walls 6 made of piezoelectric/ electrostrictive elements or antiferrodielectric elements, and a fluid channel 13 is formed between a casing 14 and a nozzle plate 9 in the fluid channel member 42. The cell 3 and the fluid channel 13 in communication with each other via a communicating hole 73 to which a communication opening 72 of the cell 3 and a nozzle 8 are both communicated. The fluid channel 13 is formed in such a way that it has substantially the same size in the width direction as the diameter of the communicating hole 72 at least at the position at which the communicating hole 72 is communicated to the fluid channel 13.

In the pump unit (A) 44 of the micro pump 101, a system fluid 31 stored in the cell 3 can be ejected into the fluid channel 13 or withdrawn therefrom, and in the fluid channel a fluid 32 which is insoluble in the system fluid 31 flows, said fluid channel being formed in the fluid channel member 42, by the change in the volume of the cell 3 due to the expansion/contraction of the side walls in the up/down direction. In other words, the system fluid 31 stored in the cell 3 can provide a change in the volume of the space extending from the communicating hole into the fluid channel 13, and therefore the fluid channel 13 for the fluid 32 can be selectively formed with the aid of this action.

In the following, a significant feature and preferable aspect of the actuator member 2 in the pump unit will be described as for an example of the pump unit (A) 44 in FIGS. 1(*a*) and (*b*). The actuator member 2 can be formed, for example, by a spacer plate 70 made of piezoelectric/electrostrictive elements or antiferrodielectric elements in which a slit (A) 5 is formed, a cover plate 7 placed on one side of the spacer 70 for covering the slit (A) 5, and a connecting plate 68 placed on the other side of the spacer 70 for covering the slit (A) 5. On both sides of slit (A) 5 of the actuator member 2, slits (B) 45 passing through the cover plate 7 and the spacer plate 70 are formed so as to face the side walls 6. That is, the cells 3 are formed by the slit (A) 5 and the cover plate 7, and each slit (B) 45 separates one cell 3 either from the spacer plate 70 in the surrounding or from the other cell 3.

The slits (B) 45 are thus formed, and the cells 3 are structurally formed to operate independently of each other, and therefore, one cell 3 can be activated completely independent of, for example, the other cell 3, although this is not shown in the drawings. As a result, the displacement of the side walls 6 as the driving member is not disturbed. As shown in FIG. 1(*a*), when the driving electric field is in the OFF state, the side walls 6 of the driving member do not deform, whereas when the driving electric field is in the ON state, the side walls 6 deforms, as shown in FIG. 1(*b*). In this case, the side walls 6 can be displaced without limitation, since the cell 3 is formed between the slits (B) 45 in the actuator member 2. As a result, a smaller field strength is required to obtain the same magnitude of deformation. The slits (B) 45 can be formed so as not to disturb the deformation of the side walls 6. For instance, the slits (B) 45 can be formed in such a manner that they have substantially the same length as the deformable part of the cover plate 7. More preferably, the slits (B) 45 can be formed in such a manner that they have substantially the same length as the axial length of the cell 3.

The pump unit including the pump unit (A) 44 is an unit for selectively forming the fluid channel in the fluid channel member by the displacement of the actuator member, and it can be employed not only for the pump member, but also for a valve member, as will be later described. Moreover, the selective formation of a fluid channel member implies the expansion/contraction of the channel in the pump member or the valve member or the opening/closing action thereof.

The expansion/contraction of the side walls, for instance, by applying a voltage to electrode layers formed on both surfaces of the side walls 6 in the actuator member 2, although this is not shown. Hence, the side walls 6 are expanded/contracted in the up/down direction in response to the driving electric field resulting from the applied voltage.

When the side walls 6 are produced by piezoelectric elements, it is desirable that the electric field for polarizing the piezoelectric elements is aligned in the same direction as the driving electric field. If the electric field for polarizing the piezoelectric elements is aligned in the same direction as the driving electric field, it is not necessary to form temporary or dummy electrodes for polarization, and to apply a voltage thereto in the manufacturing process, thereby enabling the throughput to be enhanced. Moreover, irrespective of the treatment for polarization, a manufacturing process at a temperature higher than the Curie temperature can be employed. Accordingly, it is possible to use a reflow soldering procedure or a thermosetting adhesion for fixing or wiring the micro pump to a circuit board, thereby further enhancing the throughput and thus reducing the manufacturing cost. In addition, no change in the state of polarization occurs even if the operation is made with a greater field strength, rather a more favorable state of polarization can be obtained, thus enabling a greater amount of strain to be stably obtained. As a result, a compact micro pump can be provided.

In the pump unit, it is desirable that the degree of profile for the surfaces of the side walls 6 forming the cell 3 is approximately less than 8 $\mu$m, and that the magnitude of smoothness for wall surfaces of the side walls 6 forming the cell 3 is approximately less than 10 $\mu$m. Moreover, it is desirable that the surface roughness Rt of the wall surfaces of the side walls 6 forming the cell 3 is approximately less than 10 $\mu$m. The pump unit fulfilling one of these requirements provides a smooth surface for the side walls forming the cell 3, and therefore either the concentration of the field or the concentration of stress is suppressed, thereby enabling a stable operation to be realized.

In conjunction with the above, the degree of profile is specified in Japanese industrial standard B0621, "Definition and representation of geometrical deviation". The profile of a surface means a surface which is specified in such a manner that it has a functionally determined shape, and the degree of profile for a surface means the magnitude of the deviation of the surface profile from the geometrical profile which is determined by theoretically accurate dimensions. The surface described in the present invention corresponds to a surface of the inner wall of a cell in the driving member forming the cell.

In the pump unit, moreover, it is desirable that the ratio of the inside width W (the width in the transverse direction) to the height H of the cell 3, i.e., the aspect ratio W:H in the cell 3 is approximately 1:2 to 1:40, and that the inside width W of the cell 3 is approximately 60 $\mu$m or less (the inside width W and the height H are indicated in FIG. 1(*a*)). More preferably, the aspect ratio W:H of the cell 3 should be 1:10 to 1:25 and the inside width W of the cell 3 should be 50 $\mu$m or less. The reason why the above values of the aspect ratio is favorable results form the fact that a smaller aspect ratio causes to increase the field strength for obtaining a sufficiently greater compression force, thereby increasing the risk of the dielectric breakdown, whereas a greater aspect ratio causes to reduce the mechanical strength, thereby increasing the rate of fault in the mounting and handling procedures. If the micro pump can be constructed by the pumps units fulfilling one of these requirements, or more preferably by the pump units fulfilling the two requirements, i.e., by the pump units each having a thin and small cell 3, a higher power can be obtained as a micro pump, and a more compact micro pump can be provided. There is no limitation regarding the shape of the cell, but it is preferable that the cell 3 has a substantially rectangular shape.

The characteristics or favorable features of the above-mentioned pump unit are common to all of the pump units which are used to constitute the micro pump according to the invention, including the pump unit (A) 44. The same can be found either for the micro pump 101 constituted by the pump unit (A) 44, or for the micro pump comprising the other pump unit, which will be later described. This is effective not only in the case in which the pump unit is used as a pump member, but also in the case in which the pump unit is used as a valve member.

Figure 7A:
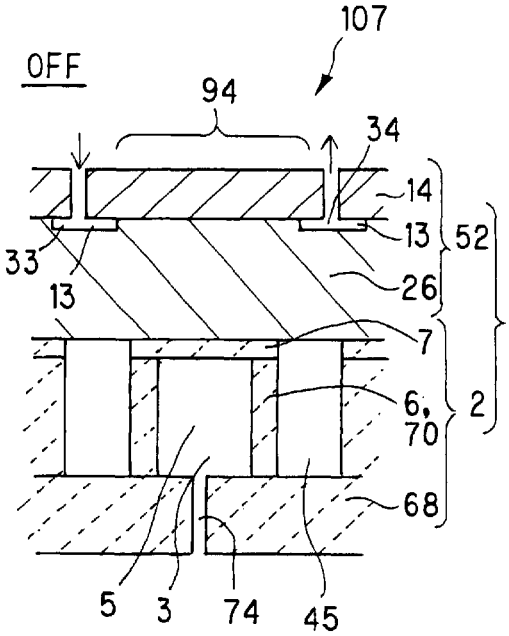
FIGS. 7(*a*) and (*b*) are sectional views of another embodiment of a micro pump according to the invention.
Figure 7B:
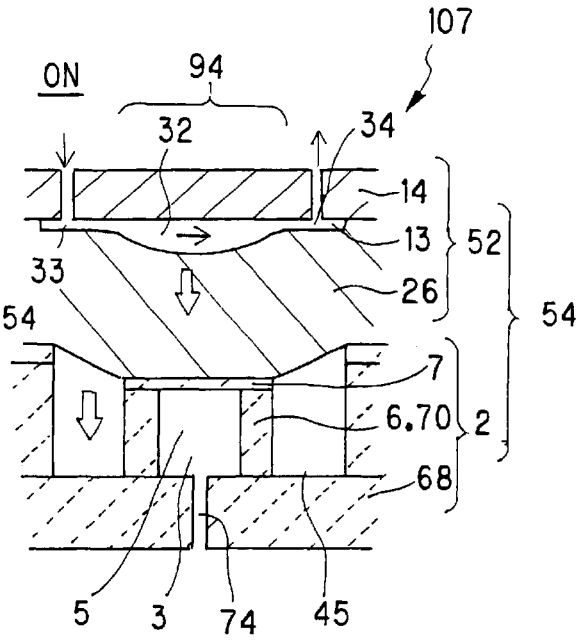

In the following, another embodiment of a micro pump, in which a pump unit other than the pump unit (A) 44 is employed, will be described. FIGS. 7(*a*) and (*b*) are sectional views of the embodiment of the micro pump according to the invention. FIG. 7(*a*) shows the deactivated (OFF) state, whereas FIG. 7(*b*) shows the activated (ON) state. A micro pump 107 comprises a pump member 94 and it is constituted by a pump unit (B) 54. The pump unit (B) 54 comprises an actuator member 2 and a fluid channel member 52. The actuator member 2 is formed by disposing two side walls 6 made of piezoelectric/electrostrictive elements or antiferrodielectric elements on a connecting plate 68 and by providing a cell 3 which is formed by covering the surfaces facing the connecting plate 68 between the side walls 6 with a cover plate 7. In the cell 3, there is a through hole 74 running to the outside of the cell, thereby allowing the side walls 6 to be expanded/contracted with ease. The fluid channel member 52 comprises a displacement transmitting member 26, at least one part of which is bonded to the cover plate 7 of the cell 3 in the actuator member 2, and a casing 14, the surface of which partially faces the displacement transmitting member 26 via the fluid channel 13, said surface being opposite to the actuator member 2.

In the pump unit (B) 54 of the micro pump 107, the displacement transmitting member 26 approaches a part of the surface of the casing 14 or departs therefrom in accordance with the expansion/contraction of the side walls 6 forming the cell 3 in the up/down direction. The fluid channel 13 for a fluid 32 is selectively formed by the approach/departure of the displacement transmitting member 26.

The fluid channel 13 can be formed in advance in the area from the supply side to the discharge side. This procedure is effective regarding the responsiveness. Moreover, the fluid channel 13 is potentially disposed, and it is possible that the displacement transmitting member 26 comes into contact with the casing 14, when the displacement transmitting member 26 approaches a part of the surface of the casing 14 facing the member at the closest spacing. This arrangement ensures to increase the rate of compression or decompression for the fluid 32, thereby enabling a compact micro pump to be provided. In the pump unit (B) 54, a supply channel 33 and a discharge channel 34 are formed on the supply and discharge sides, respectively, where there is a difficulty in the approach/departure of the displacement transmitting member 26 to the part of the surface of the casing 14. In such a position between the two states, as shown in FIG. 7(*a*), e.g., in the deactivate state, the displacement transmitting member 26 comes into contact with the casing 14, so that the fluid channel 13 cannot be formed. In the activated state, however, the fluid channel 13 is formed by the approach/departure of the displacement transmitting member 26 to the part of the surface of the casing 14, as shown in FIG. 7(*b*).

In the pump unit (B) 54, moreover, it is possible to assign a plurality of actuator members 2 in accordance with the displacement transmitting member 26 in the fluid channel member 52, although this is not shown. This arrangement can provide a greater amount of discharge, while maintaining a greater rigidity and a higher responsiveness. In this case, the actuator members 2 are arranged side by side, and it is desirable that the ratio of the spacing between a cell 3 and the adjacent cell 3 to the height of the cell 3 is approximately 1:2 to 1:40, and that the spacing between the cell 3 and the adjacent cell 3 is approximately 50 $\mu$m or less. If at least one of the two requirements is satisfied, more preferably if both requirements are satisfied, cells 3 having a high density in the arrangement can be formed, so that a more compact micro pump can be provided.

Regarding the inside width of the cell 3 or the spacing between a cell 3 and the adjacent cell 3, it is preferable that there are at least two types of dimensions. Such an procedure provides either an increase in the degree of freedom regarding the arrangement of the displacement transmitting members 26 or the cells 3 as well as regarding the ease in designing thereof.

In the pump unit (B) 54, moreover, it is desirable that the outside of the cell 3 in the actuator member 2 is filled with the same material as that of the displacement transmitting member 26 in the fluid channel member 52, and therefore the displacement transmitting member 26 and the fluid channel member 52 are unified into one body. This is due to an increased difficulty in departing the fluid channel member 52 from the cell when the side walls 6 of the cell 3 are expanded/contracted in the actuator member 2, compared with the case in which the displacement transmitting member 26 is bonded to only the cover plate 7 of the cell 3.

Another embodiment of a micro pump including another type of pump unit will be further described.

Figure 8A:
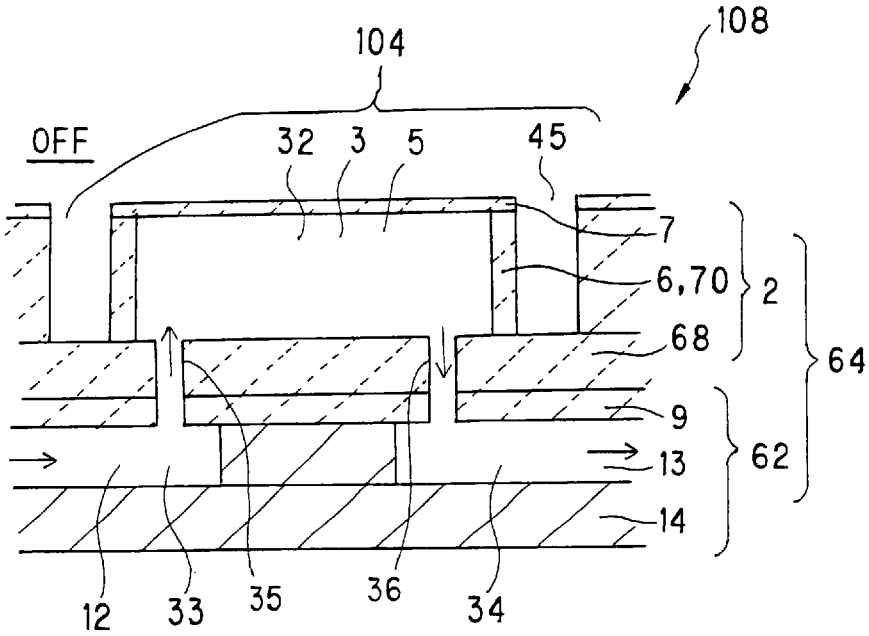
FIGS. 8(*a*) and (*b*) are sectional views of another embodiment of a micro pump according to the invention.
Figure 8B:
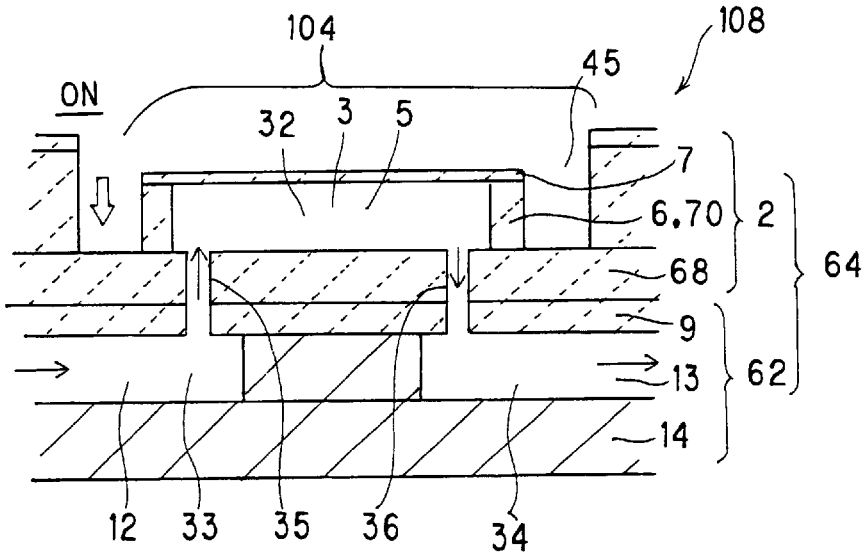
Figure 9:
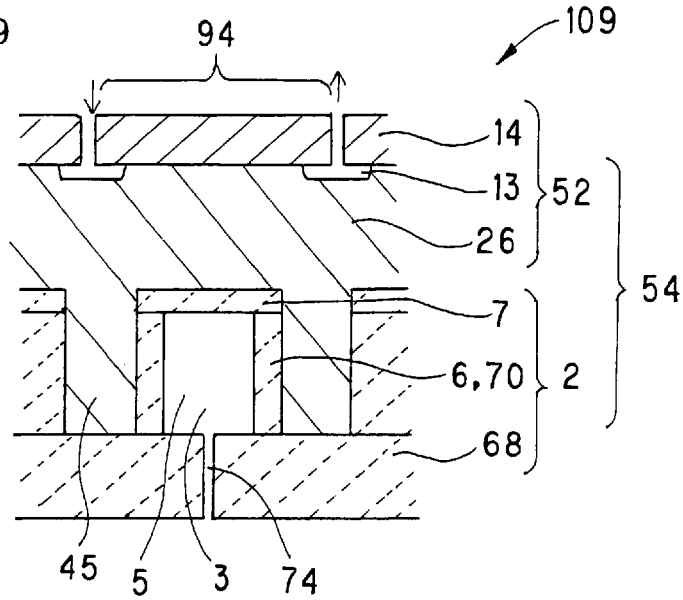
FIG. 9 is a sectional view of another embodiment of a micro pump according to the invention.

FIGS. 8(*a*) and (*b*) are sectional views of another embodiment of a micro pump according to the invention. FIG. 8(*a*) shows the deactivated (OFF) state and FIG. 8(*b*) shows the activated (ON) state. The micro pump 108 comprises a pump member 104, and is constituted by a pump unit (C) 64. The pump unit (C) 64 comprises an actuator member 2 and a fluid channel member 62. The actuator member 2 is formed by disposing two side walls 6 made of piezoelectric/electrostrictive elements or antiferrodielectric elements on a connecting plate 68, and by providing a cell 3 which is formed by covering the surfaces facing the connecting plate 68 between the side walls with a cover plate 7. A fluid supply opening 35 and a fluid discharge opening 36 are communicated to the cell 3. In the fluid channel member 62, a fluid channel 13 consisting of a supply channel 33 and a discharge channel 34 in which a fluid 32 flows is formed in advance. In this case, the supply channel 33 is communicated to the fluid supply opening 35 of the cell 3, and the discharge channel 34 is communicated to the fluid discharge opening 36.

In the pump unit (C) 64 of the micro pump 108, as shown in FIG. 8(*a*), the expansion/contraction of the side walls 6 forming the cell 3 in the up/down direction provides the change in the volume of the cell 3, thereby producing a pressure in the cell 3. As a result, the cell 3 itself becomes a part of the fluid channel 13, and a fluid channel 13, in which the fluid 32 flows, can be selectively formed.

All of the micro pumps, which are different from each other regarding the method for selectively forming the fluid channel, as exemplified above, can be regarded as a pump which provides a pressure change in the fluid channel member in response to the displacement of the actuator member which produces a change in the pressure. In the micro pumps according to the invention, it is preferable that in order to supply the fluid from the supply side to the discharge side by the action of the pressure induced in the fluid channel member, the pump member is formed as follows. Pressure loss generating elements are disposed both on the supply side and the discharge sides; the pressure loss ΔP1 in a pressure loss generating element on the supply side when the fluid flows in the supply direction, and a pressure loss ΔP2 in the same position when the fluid flows in the direction opposite to the supply direction, a pressure loss ΔP3 in the pressure loss generating element on the discharge side when the fluid flows in the discharge direction, and a pressure loss ΔP4 in the same position when the fluid flows in the direction opposite to the discharge direction satisfy the two formulae: ΔP1<ΔP4 and ΔP2>ΔP3.

Under these conditions, when a negative pressure arises in the fluid channel member in response to the displacement of the actuator member, the fluid is supplied from the supply side, because ΔP1 is greater than ΔP4. When a positive pressure arises in the fluid channel member in response to the displacement of the actuator member, the fluid is discharged from the discharge side, because ΔP3 is smaller than ΔP2. Hence, the fluid can be conveyed from the supply side to the discharge side. In order to satisfy the above formulae, the pressure loss generating element on the supply side can be formed, for instance, in a tapered shape where the cross section continuously decreases in the direction of supplying the fluid, and the pressure loss generating element on the discharge side can be formed in a tapered shape which continuously decreases in the direction of discharging the fluid. Moreover, a check valve can be disposed in the pressure loss generating element on the supply side and the discharge side. It is more desirable if separated valves are disposed in the supply side and in the discharge side.

Figure 10:
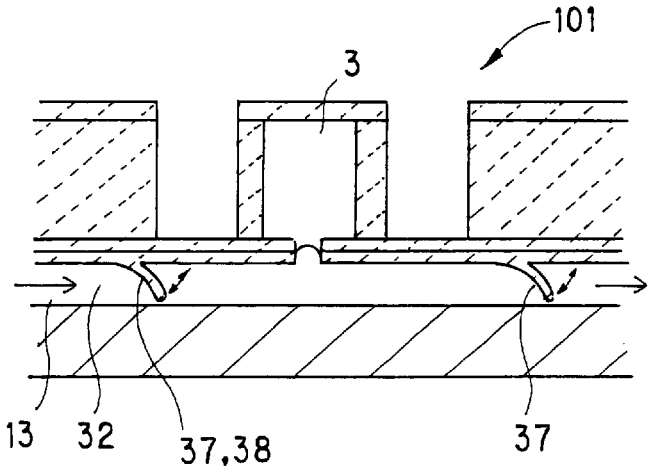
FIG. 10 is a sectional view of another embodiment of a micro pump according to the invention.
Figure 11:
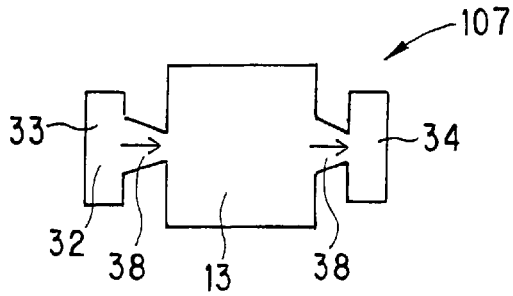
FIG. 11 is a sectional view of another embodiment of a micro pump according to the invention.
Figure 12:
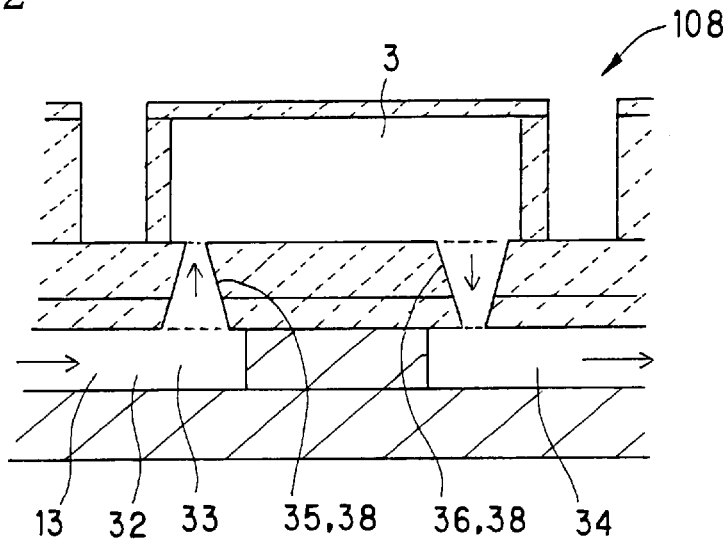
FIG. 12 is a sectional view of another embodiment of a micro pump according to the invention.

FIGS. 10 to 12 exemplify the pressure loss generating element which are formed on the supply side and the discharge side of the fluid channel in the above-mentioned micro pumps 101, 107 and 108, and which satisfy the conditions of the two equations. In the micro pump 101 shown in FIG. 10, check valves 37 are disposed as pressure loss generating element 38 on the supply side and discharge side of a fluid channel 13. FIG. 11 shows a horizontal sectional view of the micro pump 107 sown in FIGS. 7(*a*) and (*b*) at the level of a fluid channel 13. In the micro pump 107 shown in FIG. 11, a fluid channel 13 is formed between the supply channel 33 and the discharge channel 34 by the departure of the displacement transmitting member from the casing. Pressure loss generating elements 38 are formed respectively by tapering the fluid channel 13 on the supply side where the cross section is continuously decreased in the direction of supplying the fluid 32, and by tapering the fluid channel 13 on the discharge side, which continuously decreases in the direction of discharging the fluid 32. In the micro pump 108 shown in FIG. 12, pressure loss generating element 38 are formed by tapering the fluid supply opening 35 communicated to the cell 3 where the cross section is continuously decreased in the direction of supplying the fluid 32, and by tapering the fluid discharge opening 36 communicated to the cell 3 which continuously decreases in the direction of discharging the fluid 32.

In the following, several embodiments of a micro pump according to the invention will be described, wherein the micro pump includes a plurality of pump units. Firstly, a micro pump including a plurality of the pump member can be used. Regarding the connections of the pump members, it is possible to combine the serial connections with the parallel connections in an arbitrary manner. With such a combination, it is possible to amplify the compression force to the fluid as well as it is possible to increase the amount of flow. Using at least one set of serial connections and shifting the phases of the pressure fluctuation in the adjacent set of serially connected pump members in different from each other make it possible to control the flow of the fluid in the fluid channel member, even if, for example, no valve member is used.

In the case of using a plurality of pump members, it is possible to employ different pump units, for example a combination of the pump unit (A), the pump unit (B), the pump unit (C) which are described above, and the like on in each pump member. However, regarding the manufacturing cost and the pumping performance, it is more preferable to use pump units having the same structure.

Next, there is exemplified a micro pump including one or more than one pump member and co-existing one or more than one valve. By utilizing the expanding/contracting displacement of the side walls of the cell in the actuator member, the pump unit according to the invention can be used not only as a pump member, but also as a valve member. For instance, either the pump unit (A) 44 used for the micro pump 101 shown in FIGS. 1(*a*) and (*b*) or the pump unit (B) 54 used for the micro pump 107 shown in FIGS. 7(*a*) and (*b*) can be used directly as a valve member. In the pump unit (A) 44, the system fluid 31 blocks the fluid channel 13 in the activated state, as shown in FIG. 1(*b*), and this corresponds to the state in which the fluid channel is closed by a valve. In the pump unit (B) 54, the fluid channel is blocked in the deactivated state, and the fluid channel is formed in the activated state, as shown in FIGS. 7(*a*) and (*b*). Hence, this pump member can be regarded either as a pump or as a valve.

It is preferable that a valve member is interposed, for example, between the pump members. With this arrangement, the flow of the fluid can easily be controlled even for a complex micro pump system, which is constructed by the serial or parallel connections of pump members. Moreover, it is desirable that a supply valve member is disposed on the supply side of the pump member, and it is further desirable that a discharge valve member is disposed on the discharge side of the pump member. The supply valve member and the discharge valve member serve as valves for checking the flow of the fluid and as pressure loss generating element, thereby enabling the flow of the fluid to be controlled.

Each of the above-mentioned pump units can be employed as a valve member between the pump members, or as a supply valve member, or as a discharge valve member. For instance, the different pump units, such as the above-mentioned pump unit (A), pump unit (B), pump unit (C), etc., can be used as a valve member. If, however, the pump units having the same structure are used for a valve member between the pump members, or for a supply valve or for a discharge valve, it is advantageous regarding the manufacturing cost, and the properties of the valve.

Figure 13A:
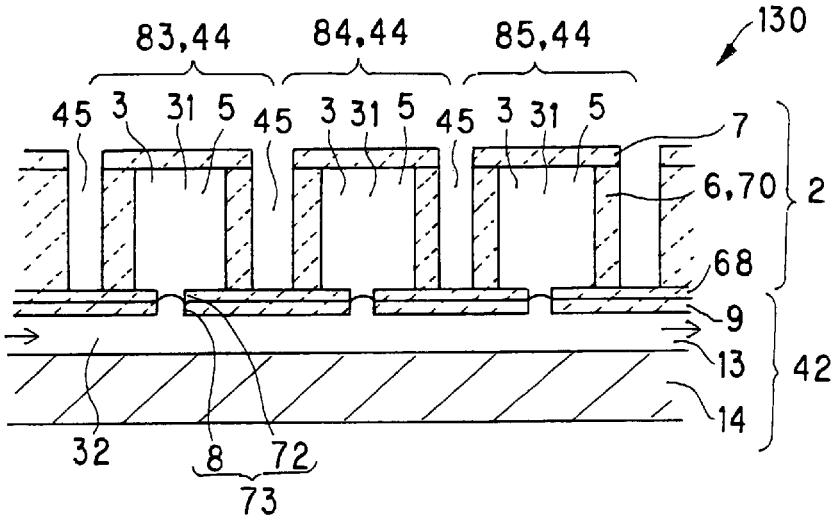
FIGS. 13(*a*) and (*b*) are sectional views of another embodiment of a micro pump according to the invention.
Figure 13B:
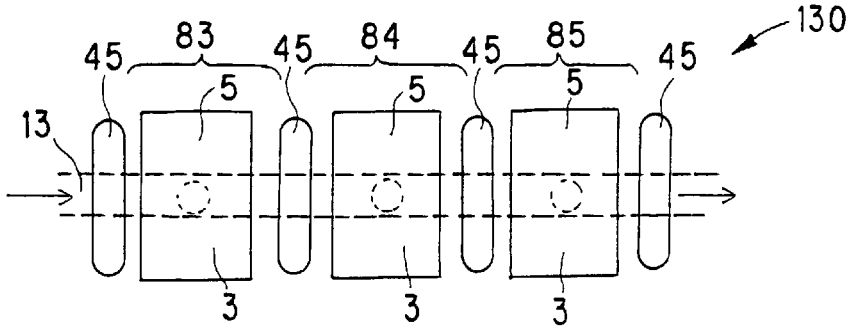

FIGS. 13(*a*) and (*b*) are sectional views of an embodiment of a micro pump according to the invention, where it includes a plurality of pump units. FIG. 13(*a*) shows a vertical section and FIG. 13(*b*) shows a horizontal section at the level of cells 3. A micro pump 130 comprises a supply valve member 83, a pump member 84 and a discharge valve member 85. The pump member 84, the supply valve member 83 and the discharge valve member 85 are each constructed similarly by a pump unit (A) 44 having an actuator member 2 in which cells 3 are formed on one surface of a fluid channel member 42 including a casing 14, a nozzle plate 9 and a fluid channel 13 in which a fluid 32 flows.

In other words, the micro pump 130 is constituted in such a manner that the side walls 6 of the driving member are expanded/contracted in each of the supply valve member 83, the pump member 84 and the discharge valve member 85, thereby changing the volume of the cell 3 and thus changing the volume of the system fluid 31 being ejected into the fluid channel 13. As a result, the fluid channel 13 in which the fluid 32 flows can be selectively formed, and therefore the flow of the fluid 32 can be controlled.

Since the side walls 6 of the cell 3 can be expanded/contracted, the side walls can be designed so as to have a desired mechanical strength without decreasing the thickness, thereby making it possible to provide a driving member having an excellent responsiveness. In this case, the cells 3 are arranged side by side, and then it is preferable that the ratio of the spacing between a cell 3 and the adjacent cell 3 to the height of the cell 3 is approximately 1:2 to 1:40 and that the spacing between the cell 3 and the adjacent cell 3 is approximately 50 $\mu$m or less. If one of the requirements is satisfied, or more preferably if both requirements are satisfied, the cell 3 can be formed in a high density, thereby enabling a more compact micro pump to be provided, even if the supply valve member 83, the pump member 84 and the discharge valve member 85 are installed.

The micro pump 130 is further constituted in a laminated structure consisting of the connecting plate 68 as a bottom layer, the spacer plate 70 as an intermediate layer and the cover plate 7 as a top layer for all of the supply valve member 83, the pump member 84 and the discharge member 85. In the spacer plate 70, slits (A) 5 providing the cells 3 formed by covering with cover plates 7 are formed, and slits (B) 45 are formed between the slit (A) 5 and the adjacent slit (A) 5, so that the cells 3 can be activated independently of each other. Accordingly, the micro pump 130 can be regarded as a laminated structure of three layers, in which slits (A) 5 and slits (B) 45 are formed in each of the areas corresponding to the pump member 84, the supply valve member 83, and the discharge member 85.

In conjunction with the above, the actuator member 2 can be formed by simultaneously firing/unifying the layers, or by adhering the layers to each other into one body, or by adhering some of the layers in the later process. Furthermore, the laminated structure is not restricted to the three-layer one, but can be formed by four or more layers.

The micro pump 130 can be operated, for instance, as follows, although this is not shown: Firstly, in the neutral state, the supply valve member 83, the pump member 84 and the discharge valve member 85 are all set in the ON state. That is, a voltage is applied to electrodes which are formed, for instance, on the side walls in each actuator member 2, so that the system fluid 31 blocks the fluid channel 13 at each corresponding position. If, for instance, the supply valve member 83 is turned off into the OFF state from the above state, the side walls of the actuator member 2 in the supply valve member 83 are expanded, and then the system fluid 31 is withdrawn into the cell 3, hence the fluid channel 13 being opened.

After that, by setting the pump member 84 in the OFF state, the side walls of the actuator member 2 in the pump member 84 are expanded and then the system fluid 31 is withdrawn into the cell 3, so that the fluid channel 13 is further opened. Subsequently, by setting the discharge valve member 85 in the OFF state, the fluid channel 13 is further opened.

When the pump member 84 and the supply valve member 83 are set in the ON state, the system fluid 31 closes the fluid channel 13 at the positions corresponding to the pump member 84 and the supply valve member 83, and by the compression force thus arisen, the fluid 32 is conveyed to the discharge side. In other words, the actuator members 2 disposed in the supply valve member 83, the pump member 84 and the discharge valve member 85 serve as means for selectively forming the fluid channel 13 at the positions corresponding to the supply valve member 83, the pump member 84 and the discharge valve member 85.

In a preferred embodiment, the supply valve member 83 and the discharge valve member 85 should be constituted in such a manner that they can provide a magnitude of their displacement for sufficiently ejecting the system fluid 31 into the fluid channel 13 to completely close the fluid channel and they have a greater rigidity. With this arrangement, the leakage of the fluid can be suppressed. The pump member 84 is preferably constituted in such a manner that it maintains a certain magnitude of the rigidity and it can increase the magnitude of displacement so as to provide a greater change in the volume of the cell 3. With this arrangement, it is possible to increase the compression force. This can be realized by appropriately choosing the inside width of the cell 3, the thickness of the side walls 6 and the surface area of at least one pair of electrodes forming the side walls 6.

Figure 14A:
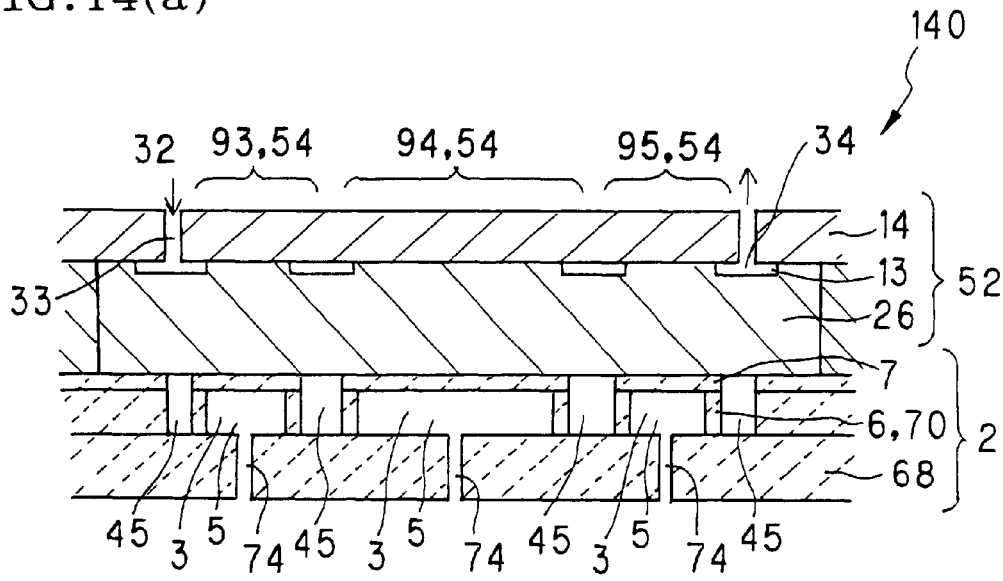
FIGS. 14(*a*) and (*b*) are sectional views of another embodiment of a micro pump according to the invention.
Figure 14B:
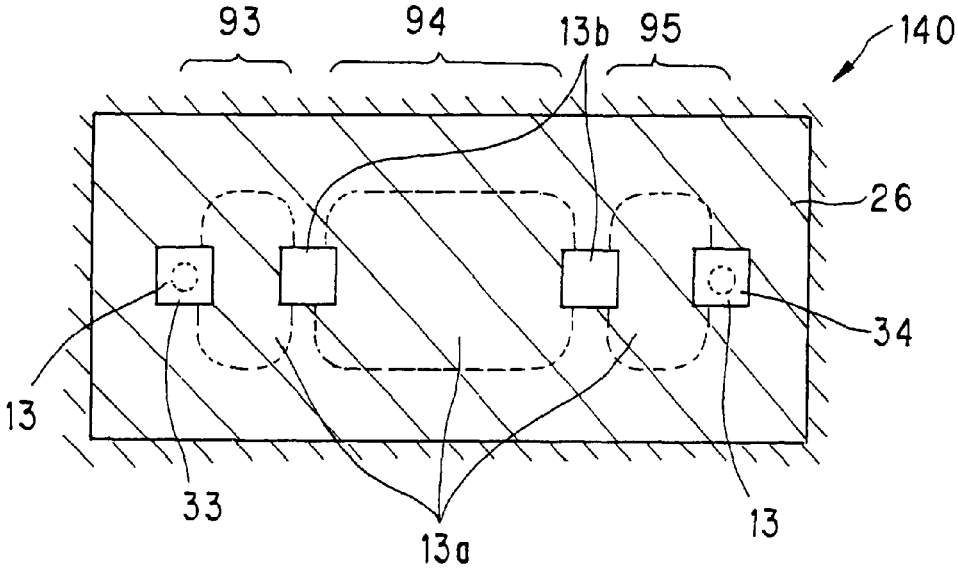

FIGS. 14(*a*) and (*b*) are sectional views of another embodiment of a micro pump according to the invention, wherein the micro pump includes a plurality of pump units. FIG. 14(*a*) shows the vertical section, and FIG. 14(*b*) shows the horizontal section at the level of the fluid channel 13. The micro 140 comprises a pump member 94, a supply valve member 93 and a discharge valve member 95. The pump member 94, the supply valve member 93 and the discharge valve member 95 are each constituted by a pump unit (B) 54 which includes a fluid channel member 52 and an actuator member 2, where said fluid channel member 52 consists of a displacement transmitting member 26, at least a part of which is bonded to a cover plate 7 of a cell 3 in the actuator member 2, and a casing 14 facing a part of one surface opposite to the actuator member 2 in the displacement transmitting member 26 via the potentially existed fluid channel 13, and said actuator member 2 has a deformable cell 3 in which a through hole 74 is disposed in a connecting plate 68 on the side opposite to the fluid channel member 52.

That is, the micro pump 140 is constituted in such a manner that, in the supply valve member 93, the pump member 94 and a discharge valve member 95, the displacement transmitting member 26 is selectively displaced in an approaching/departing movement relative to a part of the surface of the casing 14 by the expansion/contraction of the side walls 6 of the cell 3 in the up/down direction and thus the fluid channel 13 can be selectively formed on one surface of the casing 14, thereby enabling the flow of the fluid 32 to be controlled.

On the supply side of the supply valve member 93, a supply channel 33 communicated to the outside of the casing 14 via a hole is disposed, so that the fluid 32 can be supplied thereto. On the discharge side of the discharge valve member 95, a discharge channel 34 communicated to the outside of the casing 14 via a hole is disposed, so that the fluid 32 can be supplied to the other part. The hole for supplying the fluid 32 does not always pass through the casing 14, rather the supply channel 33 and the discharge channel 34 can be formed along the casing 14 (in the transverse direction in the drawing). As shown in FIG. 14(*a*), the supply valve member 93, pump member 94 and discharge member 95 are arranged in the transverse direction between the supply channel 33 and the discharge channel 34. Moreover, the supply channel 33 communicated to the outside of the casing 14 via the hole can be disposed not on the supply side of the supply valve member 93, but inside the supply valve member 93 (just above the cell 3), and also the discharge channel 34 communicated to the outside of the casing 14 via the hole can be disposed not on the discharge side of the discharge valve member 95, but inside the discharge valve member 95 (just above the cell 3). This arrangement allows to further decrease the size of the micro pump.

In FIG. 14(*b*), the areas corresponding to the specific portions of the displacement transmitting member 26 between the actuator member 2 and the casing 14, each of said areas being encircled by a broken line, contribute to the transmission of the displacement of the movable parts in the supply valve member 93, the pump member 94 and the discharge valve member 95, and form fluid channels 13*a*, when the displacement transmitting member 26 departs from the casing 14. As shown in FIGS. 14(*a*) and (*b*), concave fluid channels 13*b* in the initial state are formed in advance between the supply valve member 93 and the pump member 94 as well as between the pump member 94 and the discharge valve member 95, where it is difficult to transfer the displacement of the actuator member 2. The concave fluid channels 13*b* are communicated to the fluid channels 12*a*, and provides an effect of relieving the mutual interference between the supply valve member 93 and the pump member 94 and/or between the pump member 94 and the discharge valve member 95. In order to completely remove the mutual interference between the supply valve member 93 and the pump member 94 and/or between the pump member 94 and the discharge valve member 95, slits can be disposed in the displacement transmitting member 26, and then the displacement transmitting member 26 can be subdivided into those in the supply valve member 93, the pump member 94 and the discharge valve member 95. With this arrangement, it is possible to operate the supply valve member 93, the pump member 94 and the discharge valve member 95 independently of each other, and therefore this arrangement is useful.

The concave fluid channels 13*b* are not used, and only a fluid channel 13*a*, which is formed when the displacement transmitting member 26 departs from the casing 14 by the displacement of the actuator member 2, can be used. In other words, the whole fluid channel 13 can be potentially disposed. In this case, no space for the fluid channel exists, when it is not necessary, so that it is possible to greatly increase the rate of compression and/or the rate of decompression for the fluid 32.

On the contrary, a concave fluid channel 13*b* which proceeds from the supply side to the discharge side can be formed. In other words, the whole fluid channel 13 can be potentially disposed in advance. In this case, the rate of compression and the rate of decompression are reduced. However, this arrangement is advantageous regarding the responsiveness. In particular, when a liquid is used as a fluid, the change in the volume of the fluid channel 13 plays an essential role, so that there is no problem, even if a fluid channel 13*b* proceeding from the supply side to the discharge side is formed in advance. In any case, a new fluid channel which is different from the fluid channel 13 in the deactivated state is formed on one surface of the casing 14 by the selective displacement of the displacement transmitting member 26 relative to a part of the surface of the casing 14 in the approaching/departing direction, thereby enabling the flow of the fluid 32 to be controlled.

In the micro pump 140 including the pump unit (B), the side walls of the cell 3 are deformed in an expanding/contracting manner, as similarly in the micro pump 130 including the pump unit (A), so that a desired mechanical strength can be obtained without any need of decreasing the wall thickness, thereby making it possible to provide driving member having an excellent responsiveness. Moreover, the cells 3 are arranged side by side, and it is preferable that the ratio of the spacing between a cell 3 and the adjacent cell 3 to the height of the cell 3 is approximately 1:2 to 1:40, and it is preferable that the spacing between the cell 3 and the adjacent cell 3 is approximately 50 $\mu$m or less. If one of the requirements is satisfied, or more preferably if both requirements are satisfied, the cells 3 can be arranged in a high density, thereby enabling a more compact micro pump to be provided, even if it includes all of the supply valve member 93, pump member 94 and the discharge valve member 95.

The micro pump 140 is constituted as for all of the supply valve member 93, pump member 94 and the discharge valve member 95 in such a manner that the actuator member 2 has a laminated structure consisting of the connecting plate 68 as the bottom layer, the spacer plate 70 as the intermediate layer and the cover plate 7 as the top layer. In the spacer plate 70, a slit (A) 5 providing the cell 3 with the cover plate 7 is formed, and a slit (B) 45 is formed between the cell (A) 5 and the adjacent cell (A) 5, so that the cells 3 can be operated independently of each other. In the micro pump 140, therefore, the actuator member 2 can be regarded a triple layer structure in which the slits (A) 5 and the silts (B) 45 are formed at the portions corresponding to the supply valve member 93, pump member 94 and the discharge valve member 95.

In each slit (B) 45, it is preferable that the fluid channel member 52 is filled with the same material as that of the displacement transmitting member 26, since the fluid channel member 52 and actuator member 2 are unified, so that it is difficult to separate them from each other. The actuator member 2 can be produced by simultaneously firing/unifying into one body or by making the respective layers adhered with a glass or resign into one body, or by making them adhered afterward. Furthermore, the actuator member 2 is not restricted with the laminated structure of three layers. It is possible to employ a laminated structure of more than four layers.

As shown in FIGS. 16(*a*) to (*d*), the micro pump 130 can be operated, for instance, as follows: Firstly, in the neutral state, the supply valve member 93, pump member 94 and the discharge valve member 95 are set in the OFF state, and the end surface of the displacement transmitting member 26 is in contact with one surface of the casing 14. In this state, a voltage is applied to, for instance, electrodes formed on, e.g., the side walls of the supply valve member 93, so that the actuator member 2 turns on, e.g., it becomes in the ON state. As a result, the side walls 6 of the cell 3 in the actuator member 2 of the supply valve member 93 are displaced in the expanding/contracting direction, so that the end surface of the displacement transmitting member 26 at the position corresponding to the supply valve member 93 separates from one surface of the casing 14. Hence, a fluid channel communicated to the supply channel 33 is formed at the position corresponding to the supply valve member 93, and therefore the fluid 32 is supplied thereto.

After that, as shown in FIG. 16(*a*), the pump member 94 is set in the ON state, and then the side walls 6 of the cell 3 in the actuator member 2 of the pump member 94 expand/contract. As a result, the departure of the end surface of the displacement transmitting member 26 at the position corresponding to the pump member 94 from one surface of the casing 14 further gives rise to the formation of a fluid channel 13 at the portion corresponding to the pump member 94, so that the fluid 32 is supplied thereto. Subsequently, as shown in FIG. 16(*b*), when the supply valve member 93 becomes in the OFF state, the end surface of the displacement transmitting member 26 at the position corresponding to the supply valve member 93 again comes into contact with one surface of the casing 14, so that the fluid channel 13 is closed. As a result, the fluid 32 is stored in the fluid channel 13 at the position corresponding to the pump member 94, thereby the fluid 32 being sealed therein.

Figure 15A:
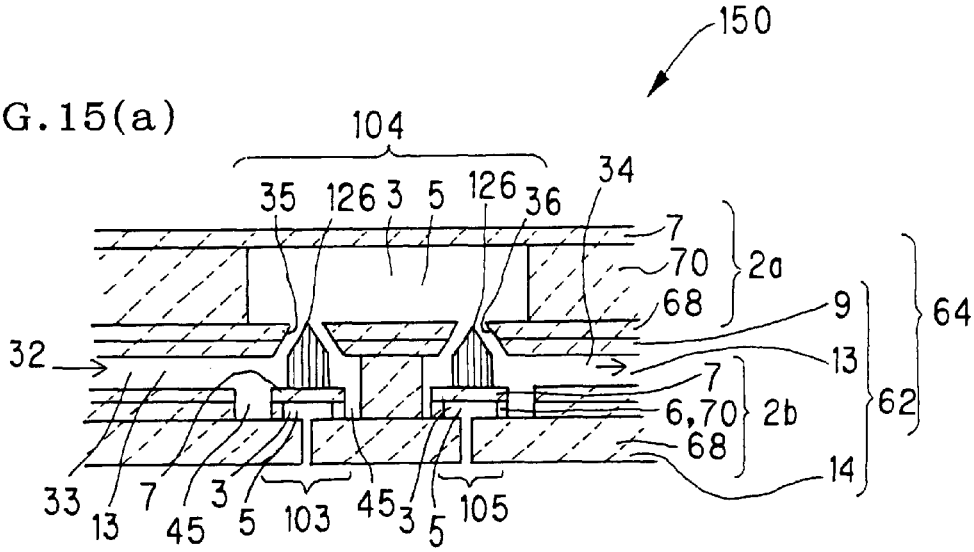
FIGS. 15(*a*) and (*b*) are sectional views of another embodiment of a micro pump according to the invention.
Figure 15B:
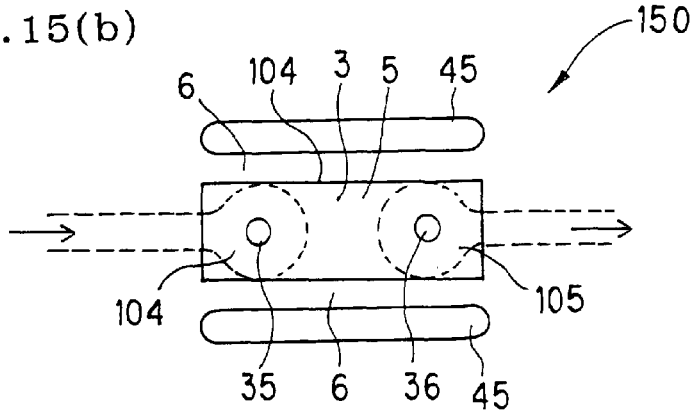
Figure 16A:
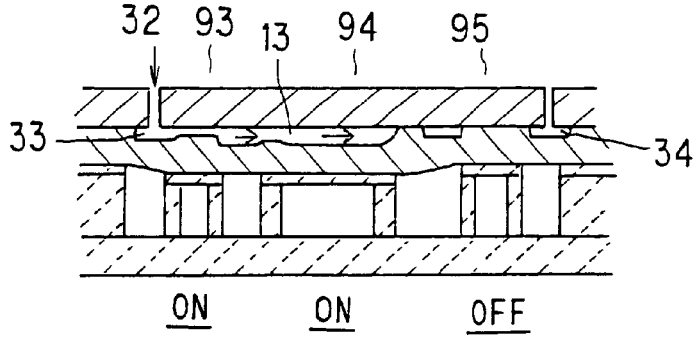
FIGS. 16(*a*) to (*d*) are drawings for explaining the function of a micro pump according to the invention.
Figure 16B:
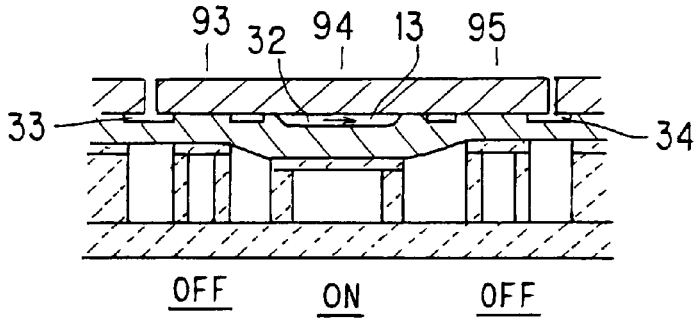
Figure 16C:
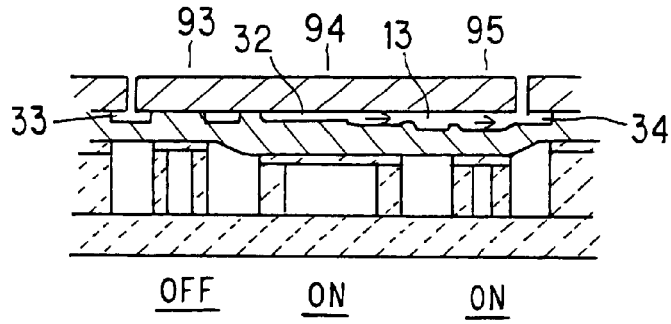
Figure 16D:
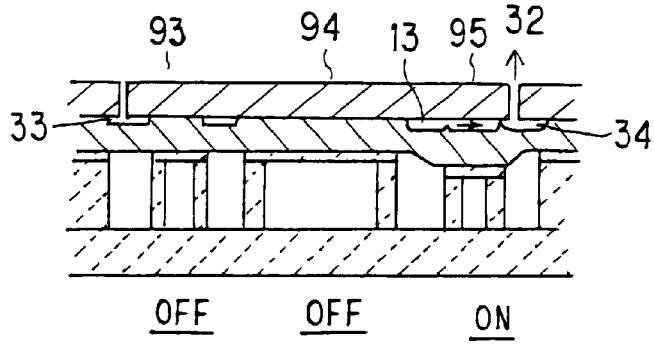

Furthermore, as shown in FIG. 16(*c*), when the discharge valve member 95 is set in the ON state, the end surface of the displacement transmitting member 26 at the position corresponding to the discharge valve member 95 separates from one surface of the casing 14, so that the fluid channel 13 is further formed, and thus the fluid 32 flows thereinto. Moreover, as shown in FIG. 15(*d*), when the pump member 94 is set in the OFF state, the end surface of the displacement transmitting member 26 again comes into contact with one surface of the casing 14 at the position corresponding to the pump member 94, and therefore, the fluid channel 13 is closed at the position corresponding to the pump member 94. As a result, the fluid 32 is ejected into the fluid channel 13 at the position corresponding to the discharge valve member 95. Furthermore, the discharge valve member 95 is set in the OFF state, and then the end surface of the displacement transmitting member 26 at the position corresponding to the discharge valve member 95 comes into contact with one surface of the casing 14. As a result, the fluid 32 in the discharge valve member 95 is discharged to the outside of the casing 14 via the discharge channel 34.

As describe above, by applying a voltage to, for instance, the electrodes formed on the side walls 6 of the cell 3 in the pump member 94, the supply valve member 93, and the discharge valve member 95 or by stopping the application of the voltage, the end surface of each displacement transmitting member 26 at the position corresponding to the pump member 94, the supply valve member 93 and the discharge valve member 95 departs from one surface of the casing 14 or comes into contact therewith, thereby as means for selectively forming the fluid channel 13. The micro pump 140 according to the invention can be formed in a shape having a smaller size and a smaller thickness, and enables the fluid channel to be selectively formed with ease, so that both the decompression on the supply side and the compression on the discharge side can be steadily achieved. Therefore, the micro pump 140 can be used with ease in various technical fields, for instance, the medicine, the chemical analysis or the like.

In a preferred embodiment, the supply valve member 93 and discharge valve member 95 are constituted in such a manner that they have a greater rigidity, while maintaining the sufficient amount of displacement for the fluid channel 13. With this arrangement, it is possible to suppress the leakage of the fluid 32. On the contrary, it is preferable that the pump member 94 should be constituted so as to provide a greater change in the volume of the cell 3 of the actuator member 2, thereby providing a greater amount of displacement, while maintaining the rigidity to some extent. This can be achieved by appropriately determining the inside width of the cell 3, the thickness of the side walls 6 and the area of at least one pair of the electrodes forming the side walls.

In the micro pump 140, the side walls 6 of the cell 3 in the actuator member 2 as the driving member are deformed in an expanding/contracting manner. This provides a greater rigidity without any need of decreasing the thickness of the side walls 6, hence enabling a high speed operation to be realized. As a result, the frequency of displacement actions is increased and thus the amount of discharge (the magnitude of displacement) of the fluid can be increased. In other words, it is possible to provide a micro pump having a small and lightweight structure, and at the same time, to increase the amount of discharge (the magnitude of displacement) of the fluid. Moreover, the micro pump 140 can be used either as a compression pump or as a decompression pump, thereby enabling the ultimate attainable pressure to be increased and thus the time required for arriving at the ultimate pressure to be reduced. Furthermore, even if the atmosphere at the outside of the system is at a negative pressure, the supply valve member 93, the pump member 94 and the discharge valve member 95 can be operated in a sufficiently good condition.

In the micro pump 140, the displacement of the actuator member 2 is transferred via the displacement transmitting member 26, so that the sealing property (the tight contact ability) is enhanced particularly in both the supply valve member 93 and the discharge valve member 95. In the neutral state (initial state), moreover, if the end surface of the displacement transmitting member 26 is designed to come into contact with one surface of the casing 14, the fluid channel 13 is potentially formed, thereby allowing the size of the micro pump to be further reduced.

FIGS. 15(*a*) and (*b*) are sectional views of an embodiment of a micro pump according to the invention, wherein the micro pump includes a plurality of pump units. FIG. 15(*a*) shows a vertical section, and FIG. 15(*b*) shows a horizontal section at the level of the cell 3 in the pump member 104 in FIG. 15(*a*). The micro pump 150 comprises a pump member 104, a supply valve member 103 and a discharge valve member 105. The micro pump 150 is a pump in which a supply valve member is disposed in the fluid supply opening 35 of the micro pump 108 shown in FIGS. 8(*a*) and (*b*), and a discharge valve member is disposed in the fluid discharge opening 36 thereof. The micro pump 150 comprises a pump unit (C) 64 consisting of an actuator member 2*a* and a fluid channel member 62, and further an actuator member 2*b* is formed in the fluid channel member 62 of the pump unit (C) 64. The actuator member 2*a* is constituted in such a manner that two side walls 6 made of piezoelectric/electrostrictive elements or antiferrodielectric elements are disposed on a connecting plate 68, and a cell 3 is formed by covering the surfaces facing the connecting plate 68 between the side walls 6 with a cover plate 7, and a fluid supply opening 35 and a fluid discharge opening 3 are communicated to the cell 3. In the fluid channel member 62, a fluid channel 13 having the supply channel 33 and the discharge channel 3, in which the fluid d2 flows, is formed in advance. The supply channel 33 is communicated to the fluid supply opening 35 of the cell 3, and the discharge channel 34 is communicated to the fluid discharge opening 36. In addition, as can be appreciated from FIG. 15(*b*), FIG. 15(*a*) shows a vertical section parallel to the slit (B) 45, as being different from that in FIG. 8(*a*), so that the slit (B) 45 of the pump member 104 is not shown in FIG. 15(*a*).

In the supply valve member 103, a cone-shaped displacement transmitting member 126 formed above the cover plate 7 closes/opens the fluid supply opening 35 by the displacement of the side walls 6 of the cell 3 in the actuator member 2 in the up/down direction. Similarly, in the discharge valve member 105, a cone-shaped displacement transmitting member 126 formed above the cover plate 7 closes/opens the fluid discharge opening 36 by the displacement of the side walls 6 of the cell 3 in the actuator member 2 in the up/down direction.

As a result, the fluid 32 supplied via the supply channel 33 is introduced into the cell 3 of the pump member 104 via the supply valve member 103. In the pump member 104, the displacement of the side walls 6 of the cell 3 in the actuator member 2 in the up/down direction produced a change in the volume of the cell 3, so that the fluid 32 in the cell 3 can be discharged via the discharge valve member 105 and the fluid discharge opening 36.

The micro pump 150 ensures to provide a small and thin structure as similarly in the micro pump 130 and the micro pump 140 which are described above, and it can be employed in various technical fields, for instance, medicine, chemical analysis, etc.

In each of the micro pump 130, the micro pump 140 and the micro pump 150 which are all described above, a serial connection of a valve member, a pump member and a valve member is employed. However, the micro pump according to the invention is not restricted to the above: A complex system which includes a serial connection or a parallel connection of one or more pump members and one or more valve members, or which includes two or more than three branching connections, two or more than three joining connections or the like can be used. Moreover, there is no restriction regarding the spatial relationship between the pump member and the valve member. Similarly, there is no restriction regarding the type of the pump unit forming either the pump member or the valve member.

In the following, the method for manufacturing a micro pump according to the invention will be described by exemplifying the micro pump 130 including three pump units (A). Firstly, an actuator member 2 is manufactured, and then joined to a fluid channel member 42 into one body, so that the micro pump 130 can be obtained. Referring now to FIGS. 3(*a*) to (*c*), an example of the process for manufacturing the actuator 2 will be schematically described. This is a method for manufacturing the actuator using a punch and a die. In FIG. 3(*a*), slit apertures 25 which become a slit (A) 5 after lamination as well as slit apertures 15 which become a slit (B) 45 after lamination are machined in green sheets 16 made of piezoelectric/electrostrictive material or antiferrodielectric material, and the lamination is simultaneously carried out with a simultaneous punching/laminating method. In this case, the green sheets 16 are laminated, and the lamination is completed at the end of punching. Hence, piezoelectric/electrostrictive elements or antiferrodielectric elements having a predetermined thickness are formed. After that, for instance, in FIG. 3(*b*), by firing and unifying the elements, a spacer plate 70 having desired slits (A) 5 and slits (B) 45 is provided, and electrodes are formed inside the slits (A) 5 which will later become cells. In FIG. 3(*c*), a cover plate 7 and a connecting plate 68 are joined to each other. In this case, the green sheets 16 can be produced with a known tape forming method, such as the doctor blade method or the like, and the formation of the electrodes can be made with a thick layer forming method, such as screen printing, spraying, coating, dipping, spreading, electrophoresis, and so, in which case, a feasible method should be adopted, depending on the size of the slits (A) which will later become cells. The screen printing is particularly useful regarding the manufacturing cost.

Figures 4A, 4B, 4C:
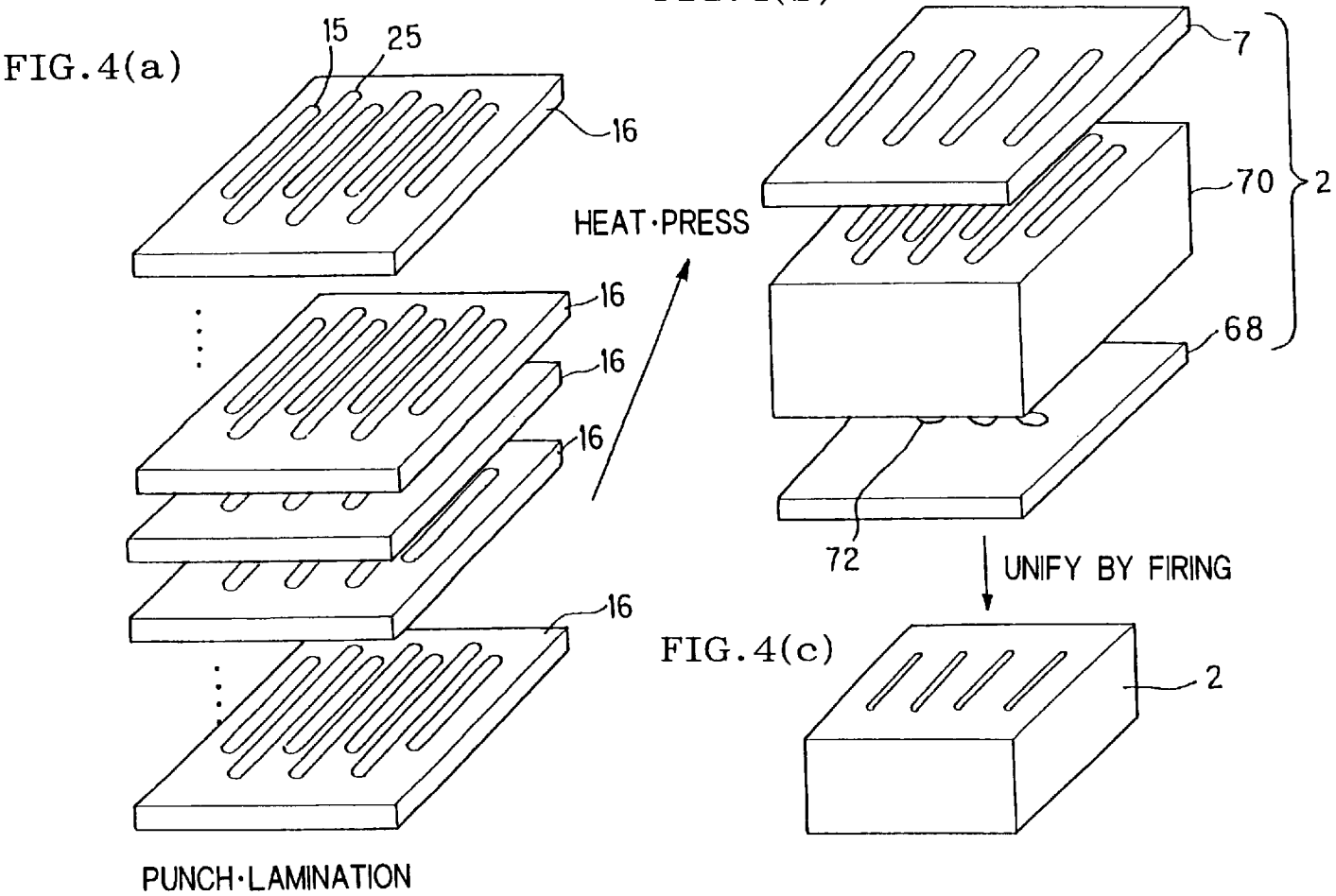
FIGS. 4(*a*) to (*c*) are schematic drawings for explaining the method for manufacturing a micro pump according to the invention in another embodiment.

Furthermore, as shown in FIGS. 4(*a*) to (*c*), the cover plate 7 and the connecting plate 68 can also be formed by the same material as the green sheets, and then laminated together with the spacer plate 70, so that they are fired and then unified. Since the cover plate 7 and the spacer plate 70 including the driving member are simultaneously fired and unified into one body of ceramic material, the durability and the rigidity of the cell are enhanced, thereby enabling a micro pump having a high responsiveness to be obtained. In this case, the formation of the electrodes are made by applying an electrode paste onto the soft green sheets, and therefore a precaution must be taken so as to provide neither damage nor deformation thereto. In addition, it is possible to form the electrodes by spreading the electrode paste on the sheet after firing and forming the cell structure. In this case, however, it is difficult to carry out the masking work, and therefore obtainable patterns of electrodes are greatly limited.

With the above manufacturing process, an actuator member 2, in which cells are formed by covering slits (A) 5 with both the cover plate 7 and the connecting plate 68, can be obtained. Subsequently, electrodes are formed on the surfaces of the side walls in the cells 3 of the actuator member 2, and then wiring to the electrodes are carried out for driving them, although this is not shown. After that, a fluid channel member 42 in which the fluid channel is disposed is joined to the actuator member at a predetermined position (see FIG. 13(*a*)). Subsequently, the cell 3 is filled with a system fluid 31. As the system fluid 31, for instance, nitrogen, inert gas such as argon, or silicon oil or the like can be used. In the micro pump thus produced, the side walls 6 of the cell 3 is expanded/contracted with a predetermined signal, so that the volume of the cell 3 is increased/decreased. Hence, the volume of the system fluid 31, which is ejected into a fluid 32, can be varied, in which case, said fluid 32 is insoluble in the system fluid and flows in the fluid channel 13, thereby making it possible to selectively form the fluid channel.

FIGS. 6(*a*) to (*e*) show the concrete simultaneous punching/laminating method which is concretely described above. In this method, a die assembly including a punch 10 and a die 12 is used, and a stripper 11 for laminating the green sheets 16 (hereafter simply referred to the sheets) is further disposed in the assembly. FIG. 6(*a*) shows the state before punching, in which case, a first sheet 16*a* is placed on the die 12. In FIG. 6(*b*), the sheet 16 is punched to form the slits by lowering the punch 10 and the stripper 11 (first substep).

Subsequently, it is ready for punching a second sheet 16*b*. In this case, as shown in FIG. 6(*c*), the first sheet 16*a* is removed from the die 12 by moving it upwards, while maintaining the sheet to be in tight contact with the stripper 11 (second substep). The method for bringing the sheet into tight contact with the stripper 11 can be realized, for instance, by evacuating air through suction holes formed in the stripper 11.

In order to punch the second sheet 16, the punch 10 and stripper 11 are moved upwards from the die 12. In the course of this movement, it is desirable that the front end of the punch 10 is not returned to the inside of the slit aperture of the first sheet 16*a* raised together therewith, and in the case of stopping, it is important to stop the front end at the position withdrawn slightly upwards from the lowest part of the first sheet 16*a* raised together therewith (third substep). If the punch 10 is returned into the apertures of the first sheet 16*a* or if it is completely stored in the stripper 11, the apertures thus formed are deformed due to the softness of the sheet 16, and therefore, the flatness of the side surfaces is reduced in the process of forming the slits by laminating the sheets 16.

FIG. 6(*d*) shows a step of punching the second sheet 16*b*. In this case, the second sheet 16*b* can be placed on the die 12 by bringing the first sheet 16*a* in tight contact with the stopper 11, so that it can be punched with ease in the substep shown in FIG. 6(*b*), and at the same time the second sheet can be stacked onto the first sheet 16*a* (fourth substep).

Repeating the steps in FIGS. 6(*c*) and (*d*), the second sheet 16*b* is placed on the first sheet 16*a* thus punched, and the these sheets are moved upwards (fifth substep), then being ready for punching a third sheet 16*c*. In this case, it is also important to stop the sheets 16*c* at the position withdrawn slightly from the lowest part of the sheets 16 moved upwards together therewith (sixth substep). After that, by repeating the fourth substep to sixth substep, a required number of the laminated sheets 16 are punched and laminated.

FIG. 6(*e*) shows the state in which the punching has been completed. When the punching and laminating of a required number of sheets 16 are completed, holding of the sheets 16 with the stripper 11 is released, thereby enabling the sheets 16 thus punched and laminated to be removed from the stripper 11. Removing from the stripper 11 can be securely carried out, using a removing tool 17 disposed on the lower surface of the stripper 11, as shown in the drawing. The above-mentioned procedures are based on the manufacturing methods, which are disclosed in Japanese Patent Application No. 2000-280573 and Japanese Patent Application No. 2001-131490. The laminated structure having a desired thickness and a desired slit shape can be obtained.

As described above, if the slit apertures are formed in the green sheets using the punch and die, and at the same time, the green sheets are laminated, and if the punch itself is used as an axis for adjusting the position of the laminated green sheets, and the punching is carried out, the deformation of slit apertures diecut by the punch is prevented, so that no deformation of the slit apertures occurs and it is possible to preserve the deviation between the laminated green sheets into less than 5 $\mu$m, so that the green sheets can be laminated with a higher accuracy. In addition, the slits having very smooth wall surfaces can be formed. As a result, even for a slit width of several tens of $\mu$m, the slits which will later forms the cells and the slits between the cells, both types of slits having a high aspect ratio of 10 to 25, can easily be formed, thereby enabling a micro pump equipped with an actuator member having excellent properties to be obtained.

Furthermore, the firing is carried out after machining the slits. The slit width at the moment of punching the sheets is substantially the same as the width at the moment of punching with the die assembly. However, since the slit width is decreased during firing, it is possible to form fine slits having a width of 40 $\mu$m or less by an appropriate combination of the thin slits machined and the shrinkage at the firing. In accordance with the design of the punching die, such as the alteration of the die shape, slits other than straight ones can be easily produced, thus enabling an optimal shape to be realized in accordance with the application.

Figure 5A:
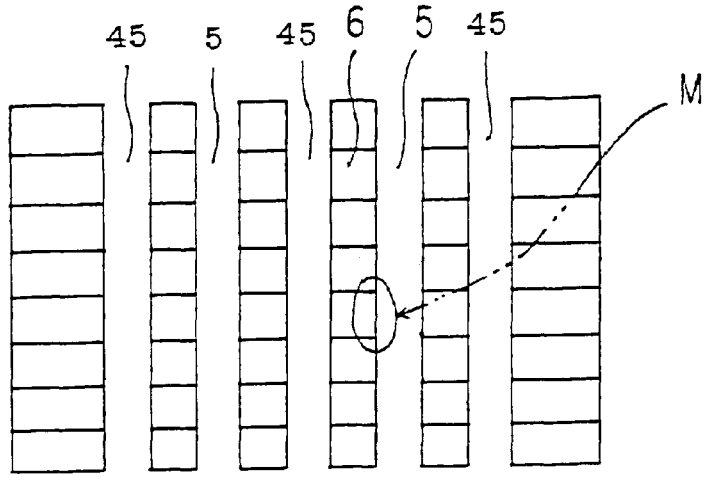
FIGS. 5(*a*) and (*b*) are a side view from P in FIG. 3(*b*) and a magnified section of M part in FIG. 5(*a*), respectively in the process of manufacturing the micro pump according to the invention with a simultaneous punching and laminating procedure.
Figure 5B:
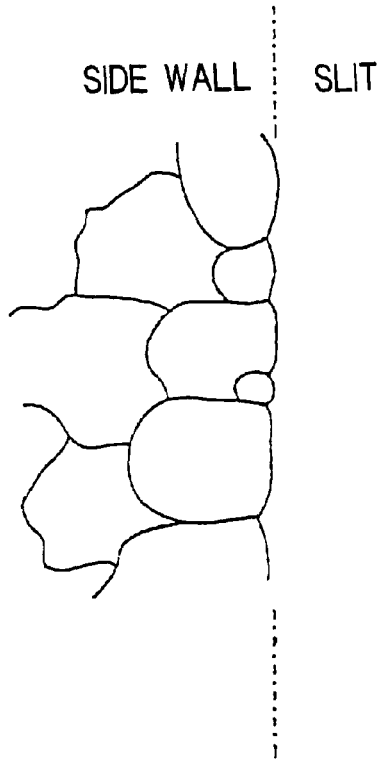

FIG. 5(*a*) shows an end surface of the spacer plate 70 viewed from P, where the spacer plate 70 is machined with the simultaneous punching/laminating method shown in FIGS. 6(*a*) to (*e*), and fired as shown in FIG. 3(*b*). FIG. 5(*b*) shows a magnified section of part M of the wall surfaces of slit (A) 5 shown in FIG. 5(*a*).

In the above described manufacturing method, the slits (A) are formed before firing, so that the surfaces of the side walls of the silts (A) which will later form cells are formed by the fired surfaces. Therefore, neither micro cracks nor transgranular fracture occur, and the state of crystal grains on the surfaces of the side walls which form the cells is less than 1% of crystal grains suffering transgranular fracture, and this is substantially zero. As a result, no deterioration of properties due to the residual compression stress occurs and the durability and reliability are enhanced.

The accuracy in stacking the green sheets with the above manufacturing method is described in an example: In the case where slits (A) having a width of 50 $\mu$m and slits (B) having a width of 30 $\mu$m are punched in green sheets having a thickness of 50 $\mu$m and a Young's modulus of 39 N/mm$^2$ and ten green sheets are laminated, the positional deviation between two adjacent sheets after firing is at best 4 $\mu$m and the surface roughness Rt is approximately 7 $\mu$m. Moreover, the width of the slits (A) after firing is reduced to about 40 $\mu$m due to the firing shrinkage.

A micro pump including a pump unit (B) and a pump unit (C) can also be produced, similarly as the micro pump 130. For instance, regarding the micro pump 140 including three pump units (B), firstly actuator members 2 are formed with the aid of the above methods shown in FIGS. 3(*a*) to (*c*) and FIGS. 6(*a*) to (*e*). Subsequently, an adhesive resin is applied thereto with the screen printing or a dispenser, and a fluid channel member 52 made of silicone resin is bonded thereto and unified into one body. After that, a micro pump 140 can be obtained, after wiring required is made, although it is not shown.

Similarly, regarding the micro pump 150 including three pump units (C), firstly actuator members 2*a* and 2*b* are produced individually. After that, the displacement transmitting member 126 is bonded to the actuator member 2*b*, and then a nozzle plate 9 having a fluid supply openings 35 and a fluid discharge opening 36 is bonded thereto and then a fluid channel 13 is formed. Thus, a micro pump 150 can be obtained, after the required wiring is carried out, although this is also not shown.

In the following, the materials, which are used in the micro pumps according to the invention, will be explained. Firstly, the material for piezoelectric/electrostrictive elements or antiferrodielectric elements used for the side walls of a cell in an actuator member as a driving member is described. As for the material used for piezoelectric/electrostrictive elements, a ceramic material containing one or two of, for example, lead zirconate, lead magnesium niobate, lead nickel niobate, lead zinc niobate, lead manganese niobate, lead antimony niobate, lead titanate, barium titanate, lead magnesium tungstate or lead cobalt niobate or the like can be employed. It is preferable that these ceramic materials are contained more than 50 weight % as main components in the material forming the piezoelectric/electrostrictive elements. It is more preferably that the ceramic material contains lead zirconate as a main component.

Moreover, it is effective that the ceramic material contains one or two oxides of lanthanum, calcium, strontium, molybdenum, tungsten, barium, niobium, zinc, nickel, manganese or the like as main components. In particular, it is preferable that the ceramic material contains a component of lead magnesium niobate, lead zirconate and lead titanate as a main component, and further contains at least one of lanthanum and strontium.

As for the material used for antiferrodielectric element, it is preferable that a ceramic material containing lead zirconate as a main component, a ceramic material containing lead zirconate and lead stannate as main components, a ceramic material containing lead zirconate as a main component and further containing a doped lanthanum oxide, or a ceramic material containing lead zirconate and lead stannate as main components and further containing doped lead zirconate or lead niobate is employed.

As for another material used for piezoelectric/electrostrictive elements, barium titanate, a ferrodielectric ceramic material of titan/barium system containing barium titanate and a polymer piezoelectric material such as polyvinyliden fluoride (PVDF) or ceramic piezoelectric material of a Bi system such as $(Bio_{0.5}Na_{0.5})TiO_3$ or a ceramic material of a Bi layer can be employed. Of course, the above materials containing doped substances and the mixture of the above material containing doped substances can also be employed. Moreover, it is preferable that the mean size of crystal grains is 0.05 to 2 $\mu$m, when the side walls of the cell are made of ceramic material, and when a greater weight in design is given to the mechanical strength of the side walls as a driving member. This is due to the fact that the mechanical strength of the side walls as a driving member can be enhanced. When a greater weight in design is given to the properties of the expansion/contraction contraction of the side walls as a driving member, it is preferable that the mean size of the crystal grains is 1 to 7 $\mu$m. This is due to the fact that a high piezoelectric/electrostrictive property can be obtained.

Regarding the connecting plate and the cover plate of the cell in the actuator member, it is preferable that they have substantially the same thermal expansion coefficient as the side walls. In particular, it is preferable that they are produced by a ceramic material, and are joined to the side walls with the laminating/firing procedure. In this case, it is possible that they are produced either by the same ceramic material as the side walls or by the ceramic material different from that of the side walls. As for the ceramics used for producing the connecting plate and cover plate of the cell, for example, stabilized zirconium oxide, aluminum oxide, magnesium oxide, titanium oxide, spinel, mullite, aluminum nitride, silicon nitride, glass, a mixture thereof or the like can be employed.

As for the material used for the electrodes formed on the side walls, there is no special limitation, so long as they are stable against an oxidizing atmosphere at a high temperature. For instance, a metal or alloy can be employed, and in another way an alloy or a mixture of dielectric ceramics and metal can be employed. More preferably, a high melting point noble metal such as platinum, palladium, rhodium or the like, or an electrode material including silver/palladium, silver/platinum, platinum/palladium or the like as main components, or a cermet material made of platinum and substrate material or, for example, piezoelectric/electrostrictive material can be employed.

It is preferable that the displacement transmitting member used in the pump unit (B) has a hardness sufficient to directly transfer the expanding/contracting displacement of the side walls of the cell in the actuator member. For example, gum, organic resin, organic adhesive film, glass or the like can be employed. The above-mentioned ceramics is also employed. More specifically, organic resin, such as epoxy resin, acrylic resin, silicone resin, polyolefin resin or the like, or a mixture thereof or organic adhesive film can be employed. Moreover, it is effective to use a mixture of the above material and a filler which permits suppressing of the hardening shrinkage. If, therefore, such a material is used, the material for the displacement transmitting member can be employed as an adhesive agent in the case of adhering the displacement transmitting member to the cover plate. The same is applicable to the displacement transmitting member consisting of the supply valve member and discharge valve member in the micro pump 150 including the pump unit (C), as described in the above embodiment.

As for the material for forming the casing, for instance, glass, quartz, plastics such as acrylic resin, ceramics, metal or the like can be employed. It is preferable that the casing cannot be corroded by a fluid which comes into contact therewith. If the casing is in contact with the displacement transmitting member, it is preferable that the casing should have a hardness sufficient to prevent the deformation due to the contact.

As described above, the micro pump according to the invention provides a small and thin structure, and at the same time, an increased amount of discharge (an increasing magnitude of displacement) of the fluid and an enhanced responsiveness.

What is claimed is:

1. A micro pump having at least one pump member for conveying a fluid by the action of pressure, comprising:

a pump unit forming from at least one actuator member for generating a pressure fluctuation, and a fluid channel in which a fluid flows, said actuator member being provided with a cell formed by disposing two side walls comprising piezoelectric/electrostrictive elements or antiferrodielectric elements on a connecting plate, and a cover plate disposed on said side walls facing said connecting plate, and said actuator member selectively forming said fluid channel and generating pressure fluctuation in said fluid channel due to displacement of said cell caused by expansion/contraction of said side walls, wherein said cell is filled with a system fluid and said fluid channel is filled with a fluid that is insoluble in said system fluid, said cell is in communication with said fluid channel through a communicating hole and said fluid channel has substantially the same size in the width direction as the diameter of said communicating hole; at least at a portion at which said communicating hole is in communication with said fluid channel, and the expansion/contraction of said side walls forming said cell in the up/down direction provides a change in the volume of a portion at which said system fluid stored in said cell is ejected from said communicating hole into said fluid channel, such that the fluid channel can be selectively formed, and said pump unit is used as a pump member, and the micro pump is provided with at least one of said pump members.

2. A micro pump according to claim 1, further comprising electrode layers formed on both surfaces of the side walls in said actuator member and said side walls are expanded/contracted in up/down directions in response to a driving electric field resulting from an application of a voltage to said electrode layers.

3. A micro pump according to claim 1, wherein in said pump unit, an electric field for polarizing the piezoelectric/electrostrictive elements forming the side walls of said actuator member is aligned in the same direction as a driving electric field.

4. A micro pump according to claim 1, wherein in said pump unit, the state of crystalline grains on surfaces of the side walls in said actuator member is such that the crystal grains suffering a transgranular fracture are 1% or less.

5. A micro pump according to claim 1, wherein in said pump unit, a degree of profile of the surfaces of the cell in said actuator member is approximately 8 $\mu$m or less.

6. A micro pump according to claim 1, wherein in said pump unit, a ratio of an inside width to a height of the cell in said actuator member is approximately 1:2 to 1:40.

7. A micro pump according to claim 1, wherein in said pump unit, an inside width of the cell in said actuator member is approximately 60 $\mu$m or less.

8. A micro pump according to claim 1, wherein in said pump unit, a surface roughness Rt of the side walls in said actuator member is approximately 10 $\mu$m or less.

9. A micro pump according to claim 1, wherein in the actuator member of said pump unit, said connecting plate comprises piezoelectric/electrostrictive elements or antiferroelectric elements and is unitarily formed with said side walls.

10. A micro pump according to claim 1, wherein in the actuator member of said pump unit, said cover plate comprises piezoelectric/electrostrictive elements or antiferrodielectric elements and is unitarily formed with said side walls.

11. A micro pump according to claim 1, further comprising a pressure loss generating element disposed on each of a supply side and a discharge side of said fluid channel, wherein a pressure loss $\Delta P1$ results when the fluid flows in the supply direction, and a pressure loss $\Delta P2$ results when the fluid flows in the direction opposite to the supply direction in the pressure lass generating element on the supply side, and a pressure loss $\Delta P3$ results when the fluid flows in the discharge direction, and a pressure loss $\Delta P4$ results when the fluid flows in the direction opposite to the discharge direction in the pressure loss generating element on the discharge side, and the following two equations are satisfied:

$$\Delta P1<\Delta P4$$

and $$\Delta P2>\Delta P3.$$

12. A micro pump according to claim 11, wherein each pressure loss generating element on the supply side and on the discharge side is a check valve.

13. A micro pump according to claim 1, wherein the actuator member in said pump unit comprises:

a spacer plate comprising piezoelectric/electrostrictive elements or antiferrodielectric elements in which a plurality of slits (A) are formed; a cover plate placed on one surface of said spacer plate covering said slits (A); and a connecting plate placed on a surface of said spacer plate that is opposite said surface on which said cover plate is placed and covering said slits (A);

wherein slits (B) passing through said cover plate and said spacer plate are formed between adjacent said slits (A).

* * * * *

UNITED STATES PATENT AND TRADEMARK OFFICE

CERTIFICATE OF CORRECTION

PATENT NO. : 6,752,601 B2
DATED : June 22, 2004
INVENTOR(S) : Yukihisa Takeuchi et al.

It is certified that error appears in the above-identified patent and that said Letters Patent is hereby corrected as shown below:

Title page,
Item [75], Inventors, change "Yukihisa Takeuchi, Nagoya (JP);" to -- Yukihisa Takeuchi, Nishikamo-gun (JP); --;
Change "Kazumasa Kitamura, Nagoya (JP);" to -- Kazumasa Kitamura, Ichinomiya (JP); --; and
Change "Nobuo Takahashi, Nagoya (JP);" to -- Nobuo Takahashi, Owariasahi (JP); --
Item [57], ABSTRACT,
Line 5, add "is" after "member"
Line 15, delete "thigh" and add -- high -- after "a"

Column 2,
Line 22, add -- the -- before the first occurrence of "pump"

Column 3,
Line 8, delete "to"
Line 22, delete "surfaces" and add -- surface -- after the first occurence of "the"

Column 24,
Line 22, delete "forming" and add -- formed -- after "unit"

Column 25,
Line 27, delete "lass" and add -- loss -- after "pressure"

Signed and Sealed this

Twenty-fourth Day of August, 2004

JON W. DUDAS
*Director of the United States Patent and Trademark Office*